US006514683B2

(12) United States Patent
Muenter et al.

(10) Patent No.: US 6,514,683 B2
(45) Date of Patent: Feb. 4, 2003

(54) PHOTOGRAPHIC ELEMENT WITH IMPROVED SENSITIVITY AND IMPROVED KEEPING

(75) Inventors: Annabel A. Muenter, Rochester, NY (US); Steven P. Szatynski, Rochester, NY (US); Sharon G. Johnston, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/755,690

(22) Filed: Jan. 5, 2001

(65) Prior Publication Data

US 2003/0008248 A1 Jan. 9, 2003

(51) Int. Cl.[7] ..... G03C 1/08

(52) U.S. Cl. ..... 430/600; 430/603; 430/607; 430/611; 430/581; 430/583; 430/375

(58) Field of Search ..... 430/583, 581, 430/600, 603, 607, 611, 375, 564

(56) References Cited

U.S. PATENT DOCUMENTS

| | | | | |
|---|---|---|---|---|
| 2,936,308 | A | | 5/1960 | Hodge |
| 3,667,958 | A | | 6/1972 | Evans |
| 5,747,235 | A | | 5/1998 | Farid et al. |
| 5,747,236 | A | | 5/1998 | Farid et al. |
| 5,763,145 | A | * | 6/1998 | Ling ..... 430/375 |
| 5,763,146 | A | | 6/1998 | Reynolds et al. |
| 5,773,208 | A | | 6/1998 | Hall et al. |
| 5,994,051 | A | | 11/1999 | Gould et al. |
| 6,010,841 | A | | 1/2000 | Farid et al. |
| 6,054,260 | A | | 4/2000 | Adin et al. |
| 6,153,371 | A | | 11/2000 | Farid et al. |

FOREIGN PATENT DOCUMENTS

| | | |
|---|---|---|
| EP | 1 022 612 | 7/2000 |

* cited by examiner

*Primary Examiner*—Janet Baxter
*Assistant Examiner*—Amanda C. Walke
(74) *Attorney, Agent, or Firm*—Edith A. Rice

(57) ABSTRACT

This invention comprises a photographic element comprising at least one light-sensitive silver halide emulsion layer containing a fragmentable electron donating compound of the formula: X—Y' or a compound which contains a moiety of the formula —X—Y';
wherein X is an electron donor moiety, Y' is a leaving proton H or a leaving group Y, with the proviso that if Y' is a proton, a base, $\beta^-$, is present in the emulsion layer, and wherein:

1) X—Y' has an oxidation potential between 0 and about 1.4 V; and
2) the oxidized form of X—Y' undergoes a bond cleavage reaction to give the radical $X^{\bullet}$ and the leaving fragment Y'; and
3) the radical $X^{\bullet}$ has an oxidation potential $\leqq -0.7$V; said photographic element further comprising a reductone of the Formula 2:

2 wherein $R^{23}$ and $R^{24}$ are the same or different, and may represent H, alkyl, cycloalkyl, aryl, or an alkyl group with a solubilizing group such as —OH, sulfonamide, sulfamoyl, or carbamoyl, or $R^{23}$ and $R^{24}$ may be joined to complete a heterocyclic ring, $R^{21}$ and $R^{22}$ are H, OH, alkyl, aryl, cycloalkyl, or may together represent an alkylidene group, n is 1 or 2 and $R^{20}$ is H, alkyl, aryl, or $CO_2R^{25}$ where $R^{25}$ is alkyl. In a preferred embodiment of the invention, the photographic element is a multicolor photographic element.

28 Claims, No Drawings

PHOTOGRAPHIC ELEMENT WITH IMPROVED SENSITIVITY AND IMPROVED KEEPING

FIELD OF THE INVENTION

This invention comprises a photographic element containing a fragmentable electron donating compound and having improved sensitivity and improved keeping, in particular improved high temperature keeping fog.

BACKGROUND OF THE INVENTION

Fragmentable two electron donors are compounds that have been designed to undergo a bond fragmentation reaction after capturing the photohole created by absorption of light in a silver halide emulsion. The radical resulting from this bond fragmentation reaction is designed to be sufficiently energetic so as to inject an electron into the silver halide emulsion. Consequently, absorption of one photon by a silver halide emulsion containing a fragmentable two electron donor results in creation of two electrons in the silver halide emulsion, the first resulting from the initial absorption of the photon and the second resulting from the sequence of reactions caused by capture of the photohole at the fragmentable two electron donor. The production of this second electron leads to increased photographic speed. Fragmentable two electron donors have been described in U.S. Pat. Nos. 5,747,235, 5,747,236, 5,994,051, and 6,010,841, 6,054,260 and 6,153,371. These references disclose speed gains associated with the use of fragmentable two-electron donors in a wide variety of silver halide emulsions. Recently, as disclosed in co-pending application Ser. No. 09/755,419 filed Jan. 5, 2001, we have also found that low levels of fragmentable two-electron donors are useful for controlling losses of latent image that may occur between exposure and processing of a multicolor film element. However, it is also frequently found that addition of a fragmentable two-electron donor to an emulsion increases the fog that results when the photographic element is stored at elevated temperatures, called high temperature keeping fog. These fog increases occur in spite of the use of antifoggants such as tetraazaindenes and/or hydroxybenzene compounds to control the fresh fog in the emulsion layers containing the fragmentable two-electron donors. Such high temperature keeping fog increases can limit the ability to use the fragmentable two electron donors as speed or latent image keeping addenda.

PROBLEM TO BE SOLVED BY THE INVENTION

Consequently, it is desirable to find new means to control high temperature keeping fog associated with the fragmentable two-electron donors.

SUMMARY OF THE INVENTION

One aspect of this invention comprises a photographic element comprising at least one light-sensitive silver halide emulsion layer containing a fragmentable electron donating compound of the formula: X—Y' or a compound which contains a moiety of the formula —X—Y';

wherein

X is an electron donor moiety, Y' is a leaving proton H or a leaving group Y, with the proviso that if Y' is a proton, a base, $\beta^-$, is present in the emulsion layer, and wherein:

1) X—Y' has an oxidation potential between 0 and about 1.4 V; and 2) the oxidized form of X—Y' undergoes a bond cleavage reaction to give the radical $X^{\bullet}$ and the leaving fragment Y'; and 3) the radical $X^{\bullet}$ has an oxidation potential $\leqq -0.7$V (that is, equal to or more negative than about −0.7V);

said photographic element further comprising a reductone of the Formula 2:

2

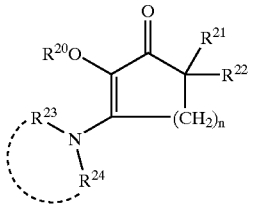

wherein $R^{23}$ and $R^{24}$ are the same or different, and may represent H, alkyl, cycloalkyl, aryl, or an alkyl group with a solubilizing group such as —OH, sulfonamide, sulfamoyl, or carbamoyl, or $R^{23}$ and $R^{24}$ may be joined to complete a heterocyclic ring, $R^{21}$ and $R^{22}$ are H, OH, alkyl, aryl, cycloalkyl, or may together represent an alkylidene group, n is 1 or 2 and $R^{20}$ is H, alky, aryl, or $CO_2R^{25}$ where $R^{25}$ is alkyl.

In a preferred embodiment of the invention the photographic element comprises a multicolor photographic element comprising a support bearing a cyan dye image-forming unit comprising at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, a yellow dye image-forming unit comprising at least one blue-sensitive silver halide emulsion layer having associated therewith at least one yellow dye-forming coupler.

ADVANTAGEOUS EFFECT OF THE INVENTION

This invention provides a multicolor photographic element with improved speed and/or improved latent image keeping characteristics that also has minimal growth of fog (Dmin) at high temperatures.

DETAILED DESCRIPTION OF THE INVENTION

We have found that addition of a reductone compound to a multicolor photographic element containing a fragmentable two-electron donor can significantly improve the high temperature keeping fog associated with the fragmentable two-electron donor. Reductones are known in the art as an addendum for photographic materials, as described for example in Research Disclosure, Item 37038 of February 1995. Hall et al. in U.S. Pat. No. 5,773,208 describe improved latent image keeping behavior of epitaxially sensitized tabular emulsions in the presence of a hexose reductone. In addition, Reynolds et al. in U.S. Pat. No. 5,763,146 describe water soluble reductones that give latent image keeping improvements as well as improvements in speed loss on keeping. Reductones are also discussed in U.S. Pat. No. 2,936,308 and U.S. Pat. No. 3,667,958. The reductones are known reducing agents and can be photographic developers. Thus, it is surprising that these compounds in combination with the fragmentable two-electron donors can actually give less high temperature keeping fog. Further, we have found that the latent image keeping benefits associated with the use of reductones can advantageously be combined with the latent image keeping benefits derived from the use of low levels of fragmentable two-electron donors.

In accordance with this invention the silver halide emulsion contains a fragmentable electron donating (FED) compound which enhances the sensitivity of the emulsion. The fragmentable electron donating compound is of the formula X—Y' or a compound which contains a moiety of the formula —X—Y';

wherein

X is an electron donor moiety, Y' is a leaving proton H or a leaving group Y, with the proviso that if Y' is a proton, a base, $\beta^-$, is present in the emulsion layer, and wherein:

1) X—Y' has an oxidation potential between 0 and about 1.4 V; and
2) the oxidized form of X—Y' undergoes a bond cleavage reaction to give the radical $X^\bullet$ and the leaving fragment Y'; and
3) the radical $X^\bullet$ has an oxidation potential $\leqq -0.7$V (that is, equal to or more negative than about −0.7V).

In this patent application, oxidation potentials are reported as "V" which represents "volts versus a saturated calomel reference electrode".

In embodiments of the invention in which Y' is Y, the following represents the reactions that are believed to take place when X—Y undergoes oxidation and fragmentation to produce a radical $X^\bullet$, which in a preferred embodiment undergoes further oxidation.

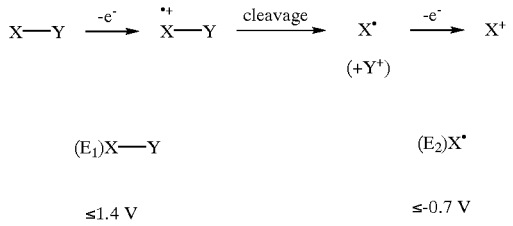

where $E_1$ is the oxidation potential of X—Y and $E_2$ is the oxidation potential of the radical $X^\bullet$.

$E_1$ is preferably no higher than about 1.4 V and preferably less than about 1.0 V. The oxidation potential is preferably greater than 0, more preferably greater than about 0.3 V. $E_1$ is preferably in the range of about 0 to about 1.4 V, and more preferably from about 0.3 V to about 1.0 V.

In this invention the oxidation potential, $E_2$, of the radical $X^\bullet$ is equal to or more negative than −0.7V, preferably more negative than about −0.9 V. $E_2$ is preferably in the range of from about −0.7 to about −2 V, more preferably from about −0.8 to about −2 V and most preferably from about −0.9 to about −1.6 V.

The structural features of X—Y are defined by the characteristics of the two parts, namely the fragment X and the fragment Y. The structural features of the fragment X determine the oxidation potential of the X—Y molecule and that of the radical $X^\bullet$, whereas both the X and Y fragments affect the fragmentation rate of the oxidized molecule $X—Y^{\bullet+}$.

In embodiments of the invention in which Y' is H, the following represents the reactions believed to take place when the compound X—H undergoes oxidation and deprotonation to the base, $\beta^-$, to produce a radical $X^\bullet$, which in a preferred embodiment undergoes further oxidation.

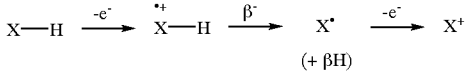

As mentioned above, the base $\beta^\bullet$ is present in the emulsion. It is specifically contemplated that the base $\beta^\bullet$ is in the emulsion by virtue of being covalently linked to X.

Preferred X groups are of the general formula:

(I)

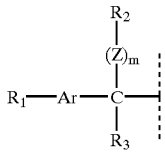

(II)

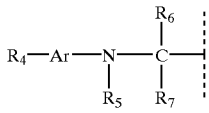

(III)

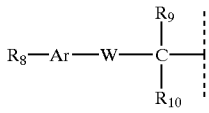

or (IV)

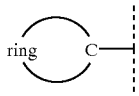

The symbol "R" (that is R without a subscript) is used in all structural formulae in this patent application to represent a hydrogen atom or an unsubstituted or substituted alkyl group.

In structure (I):

m=0, 1;

Z=O, S, Se, Te;

Ar=aryl group (e.g., phenyl, naphthyl, phenanthryl, anthryl); or heterocyclic group (e.g., pyridine, indole, benzimidazole, thiazole, benzothiazole, thiadiazole, etc.);

$R_1$=R, carboxyl, amide, sulfonamide, halogen, $NR_2$, $(OH)_n$, $(OR')_n$, or $(SR)_n$;

R'=alkyl or substituted alkyl, n=1–3;

$R_2$=R, Ar';

$R_3$=R, Ar';

$R_2$ and $R_3$ together can form 5- to 8-membered ring;

$R_2$ and Ar=can be linked to form 5- to 8-membered ring;

$R_3$ and Ar=can be linked to form 5- to 8-membered ring;

Ar'=aryl group such as phenyl, substituted phenyl, or heterocyclic group (e.g., pyridine, benzothiazole, etc.)

R=a hydrogen atom or an unsubstituted or substituted alkyl group.

In structure (II):

Ar=aryl group (e.g., phenyl, naphthyl, phenanthryl); or heterocyclic group (e.g., pyridine, benzothiazole, etc.);

$R_4$=a substituent having a Hammett sigma value of −1 to +1, preferably −0.7 to +0.7, e.g., R, OR, SR, halogen, CHO, C(O)R, COOR, $CONR_2$, $SO_3R$, $SO_2NR_2$, $SO_2R$, SOR, C(S)R, etc;

$R_5$=R, Ar'

$R_6$ and $R_7$=R, Ar'

$R_5$ and Ar=can be linked to form 5- to 8-membered ring;

$R_6$ and Ar=can be linked to form 5- to 8-membered ring (in which case, $R_6$ can be a hetero atom);

$R_5$ and $R_6$ can be linked to form 5- to 8-membered ring;

$R_6$ and $R_7$ can be linked to form 5- to 8-membered ring;

Ar'=aryl group such as phenyl, substituted phenyl, heterocyclic group;

R=hydrogen atom or an unsubstituted or substituted alkyl group.

A discussion on Hammett sigma values can be found in C. Hansch and R. W. Taft *Chem. Rev.* Vol 91, (1991) p 165, the disclosure of which is incorporated herein by reference.

In structure (III):

W=O, S, Se;

Ar=aryl group (e.g., phenyl, naphthyl, phenanthryl, anthryl); or heterocyclic group (e.g., indole, benzimidazole, etc.)

$R_8$=R, carboxyl, NR2, $(OR)_n$, or $(SR)_n$ (n=1–3);

$R_9$ and $R_{10}$=R, Ar';

$R_9$ and Ar=can be linked to form 5- to 8-membered ring;

Ar'=aryl group such as phenyl substituted phenyl or heterocyclic group;

R=a hydrogen atom or an unsubstituted or substituted alkyl group.

In structure (IV):

"ring" represents a substituted or unsubstituted 5-, 6- or 7-membered unsaturated ring, preferably a heterocyclic ring.

The following are illustrative examples of the group X of the general structure I:

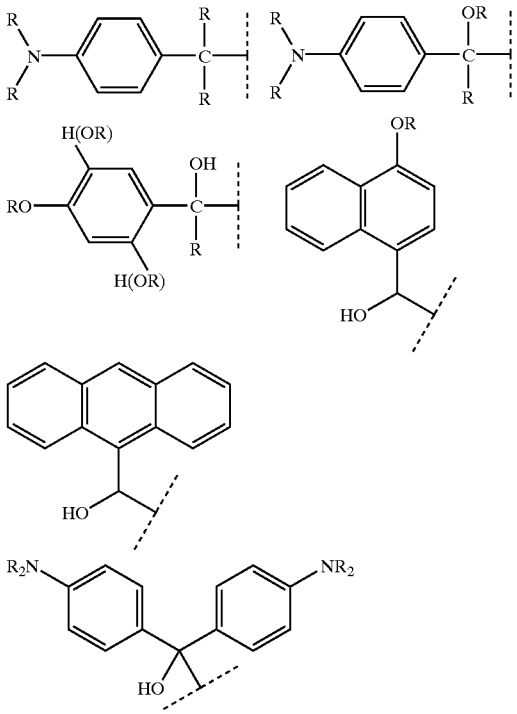

-continued

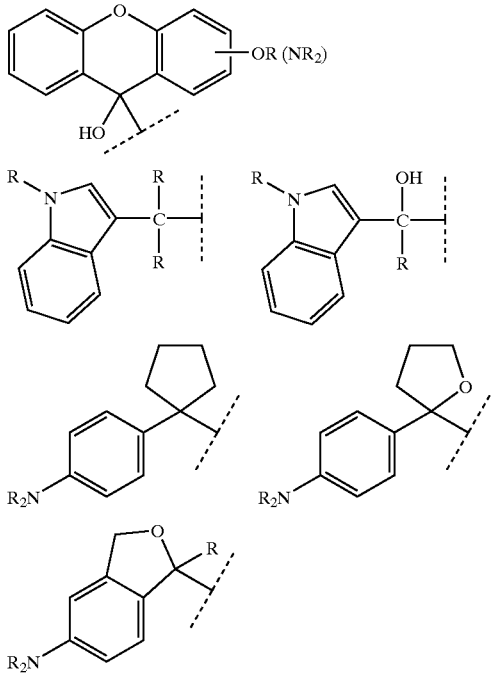

In the structures of this patent application a designation such as —OR($NR_2$) indicates that either —OR or —$NR_2$ can be present.

The following are illustrative examples of the group X of general structure II.

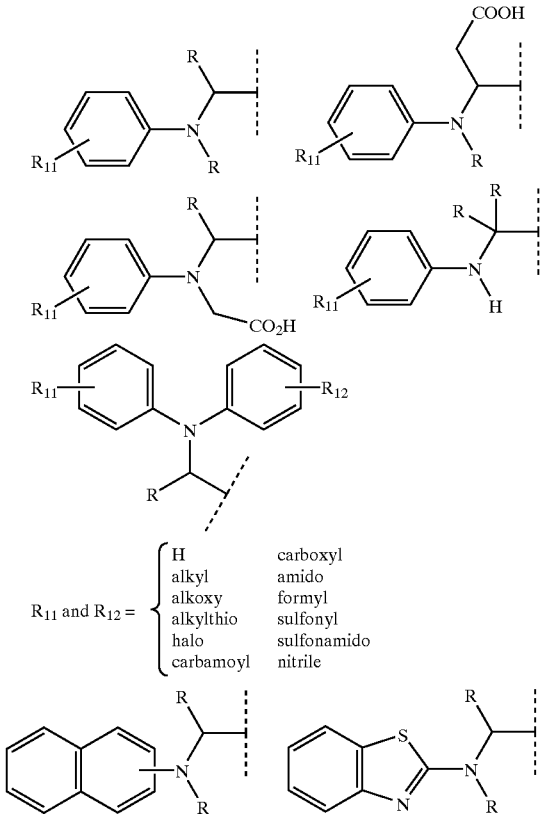

-continued

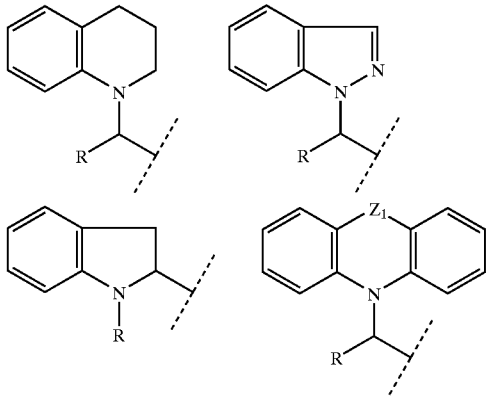

$Z_1$=a covalent bond, S, O, Se, NR, $CR_2$, CR═CR, or $CH_2CH_2$.

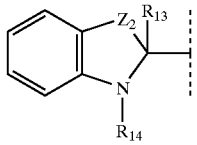

$Z_2$=S, O, Se, NR, $CR_2$, CR═CR, $R_{13}$, =alkyl, substituted alkyl or aryl, and $R_{14}$=H, alkyl substituted alkyl or aryl.

The following are illustrative examples of the group X of the general structure III:

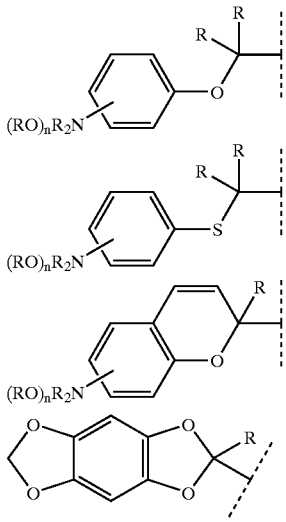

n = 1–3

The following are illustrative examples of the group X of the general structure IV:

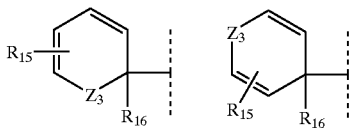

-continued

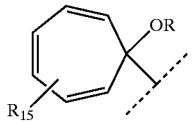

$Z_3$=O, S, Se, NR $R_{15}$=R, OR, $NR_2$ $R_{16}$=alkyl, substituted alkyl

Preferred Y' groups are:

(1) X', where X' is an X group as defined in structures I–IV and may be the same as or different from the X group to which it is attached (2)

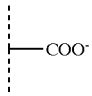

(3)

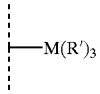

where M=Si, Sn or Ge; and R'=alkyl or substituted alkyl (4)

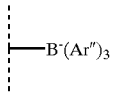

where Ar"=aryl or substituted aryl (5)

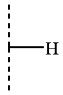

In preferred embodiments of this invention Y' is —H, —$COO^-$ or —$Si(R')_3$ or —X'. Particularly preferred Y' groups are —H, —$COO^-$ or —$Si(R')_3$.

In embodiments of the invention in which Y' is a proton, a base, $\beta^-$, is present in the emulsion layer and may be covalently linked directly or indirectly to X. The base is preferably the conjugate base of an acid of pKa between about 1 and about 8, preferably about 2 to about 7. Collections of pKa values are available (see, for example: Dissociation Constants of Organic Bases in Aqueous Solution, D. D. Perrin (Butterworths, London, 1965); CRC Handbook of Chemistry and Physics, 77th ed, D. R. Lide (CRC Press, Boca Raton, Fla., 1996)). Examples of useful bases are included in Table I.

TABLE 1

| pKa's in water of the conjugate acids of some useful bases | |
|---|---|
| $CH_3$—$CO_2^-$ | 4.76 |
| $C_2H_5$—$CO_2^-$ | 4.87 |
| $(CH_3)_2CH$—$CO_2^-$ | 4.84 |
| $(CH_3)_3C$—$CO_2^-$ | 5.03 |
| HO—$CH_2$—$CO_2^-$ | 3.83 |

TABLE 1-continued

| pKa's in water of the conjugate acids of some useful bases | |
|---|---|
| $S—CH_2—CO_2^-$ | 3.48 |
| $CH_3—CO—NH—CH_2—CO_2^-$ | 3.67 |
| $CO_2^-$ | 4.19 |
| $N$ $CO_2^-$ | 4.96 |
| $CH_3—COS^-$ | 3.33 |
| $H_2N$ $SO_3^-$ | 3.73 |
| $Me$ $SeO_3^-$ | 4.88 |
| $H$ $N$ $CH^-$ $O$ $N$ $O$ $O$ $H$ | 4.01 |
| $Me$ $N$ $CH^-$ $O$ $N$ $O$ $O$ $Me$ | 4.7 |
| $(CH_3)_3N^+—O^-$ | 4.65 |
| $H_2N—CH_2—CH(CH_3)—\overset{+}{N}H_3$ | 6.61 |
| $N$ | 5.25 |
| $Me$ $Me$ $N$ | 6.15 |
| $S$ $N$ | 2.44 |

TABLE 1-continued

| pKa's in water of the conjugate acids of some useful bases | |
|---|---|
| $N$ $N$ $H$ | 5.53 |

Preferably the base, $\beta^-$ is a carboxylate, sulfate or amine oxide.

In some embodiments of the invention, the fragmentable electron donating compound contains a light absorbing group, Z, which is attached directly or indirectly to X, a silver halide absorptive group, A, directly or indirectly attached to X, or a chromophore forming group, Q, which is attached to X. Such fragmentable electron donating compounds are preferably of the following formulae:

$$Z—(L—X—Y')_k$$

$$A—(L—X—Y')_k$$

$$(A—L)_k—X—Y'$$

$$Q—X—Y'$$

$$A—(X—Y')_k$$

$$(A)_k—X—Y'$$

$$Z—(X—Y')_k$$

or $$(Z)_k—X—Y'$$

Z is a light absorbing group;

k is 1 or 2;

A is a silver halide adsorptive group that preferably contains at least one atom of N, S, P, Se, or Te that promotes adsorption to silver halide;

L represents a linking group containing at least one C, N, S, P or O atom; and

Q represents the atoms necessary to form a chromophore comprising an amidinium-ion, a carboxyl-ion or dipolar-amidic chromophoric system when conjugated with X—Y'.

Z is a light absorbing group including, for example, cyanine dyes, complex cyanine dyes, merocyanine dyes, complex merocyanine dyes, homopolar cyanine dyes, styryl dyes, oxonol dyes, hemioxonol dyes, and hemicyanine dyes.

Preferred Z groups are derived from the following dyes:

Dye 1

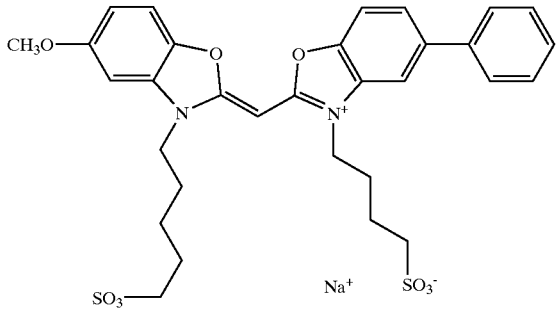

Dye 2

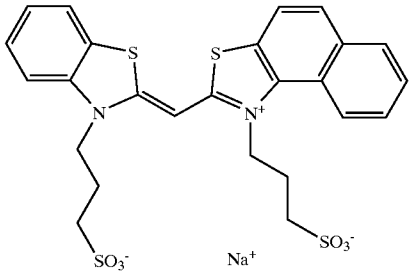

Dye 3

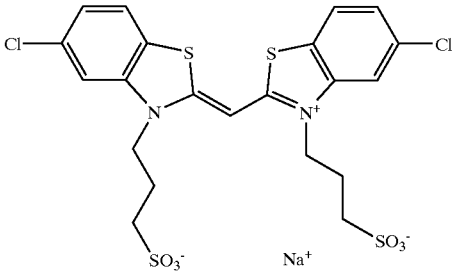

Dye 4

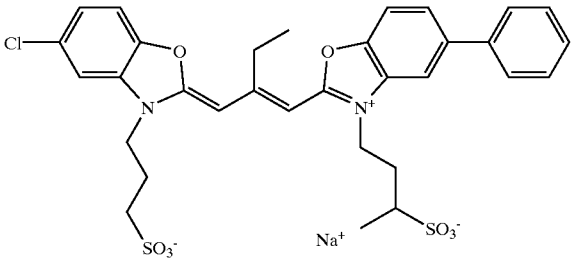

Dye 5

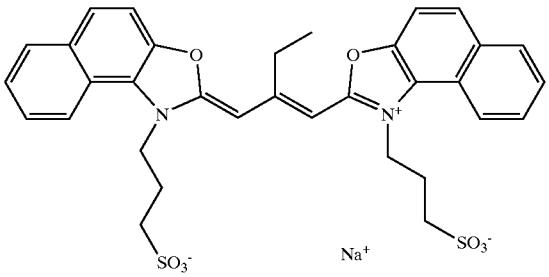

-continued

Dye 6

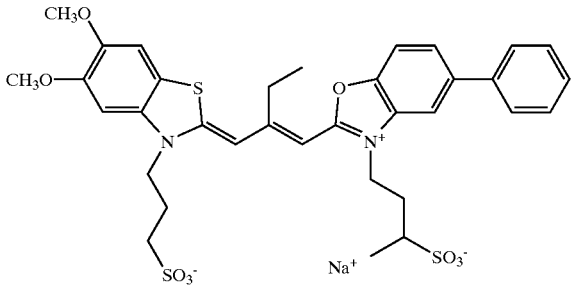

Dye 7

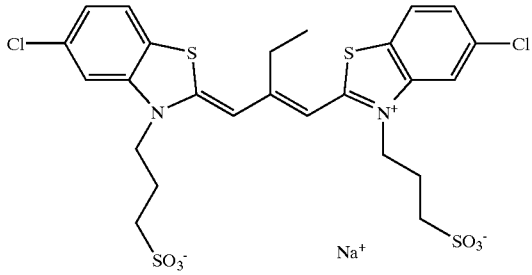

and

Dye 8

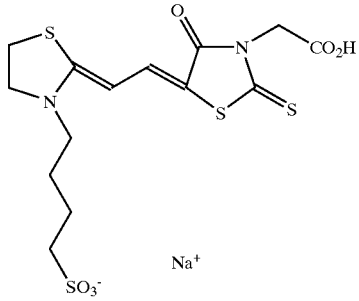

The linking group L may be attached to the dye at one (or more) of the heteroatoms, at one (or more) of the aromatic or heterocyclic rings, or at one (or more) of the atoms of the polymethine chain, at one (or more) of the heteroatoms, at one (or more) of the aromatic or heterocyclic rings, or at one (or more) of the atoms of the polymethine chain. For simplicity, and because of the multiple possible attachment sites, the attachment of the L group is not specifically indicated in the generic structures.

The silver halide adsorptive group A is preferably a silver-ion ligand moiety or a cationic surfactant moiety. In preferred embodiments, A is selected from the group consisting of: i) sulfur acids and their Se and Te analogs, ii) nitrogen acids, iii) thioethers and their Se and Te analogs, iv) phosphines, v) thionamides, selenamides, and telluramides, and vi) carbon acids.

Illustrative A groups include:

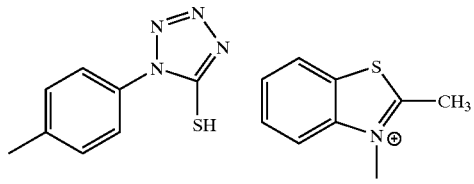

-continued

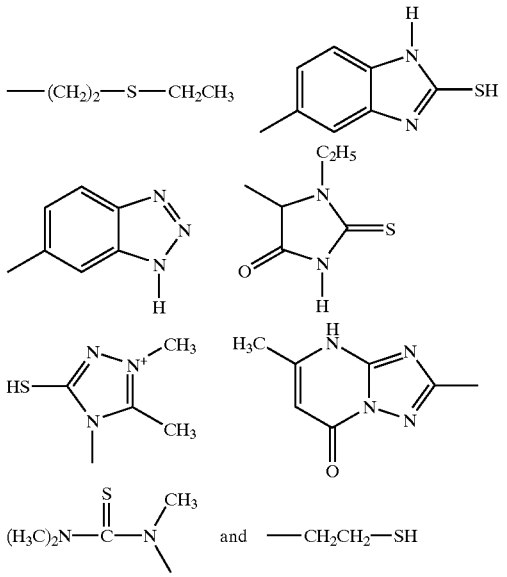

and

The point of attachment of the linking group L to the silver halide adsorptive group A will vary depending on the structure of the adsorptive group, and may be at one (or more) of the heteroatoms, at one (or more) of the aromatic or heterocyclic rings.

The linkage group represented by L which connects the light absorbing group to the fragmentable electron donating group XY by a covalent bond is preferably an organic linking group containing a least one C, N, S, or O atom. It is also desired that the linking group not be completely aromatic or unsaturated, so that a pi-conjugation system cannot exist between the Z and XY moieties. Preferred examples of the linkage group include, an alkylene group, an arylene group, —O—, —S—, —C═O, —$SO_2$—, —NH—, —P═O, and —N═. Each of these linking components can be optionally substituted and can be used alone or in combination. Examples of preferred combinations of these groups are:

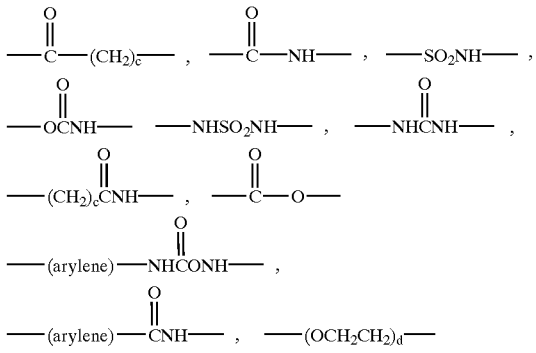

where c = 1–30, and d = 1–10 where c=1–30, and d=1–10.

The length of the linkage group can be limited to a single atom or can be much longer, for instance up to 30 atoms in length. A preferred length is from about 2 to 20 atoms, and most preferred is 3 to 10 atoms. Some preferred examples of L can be represented by the general formulae indicated below:

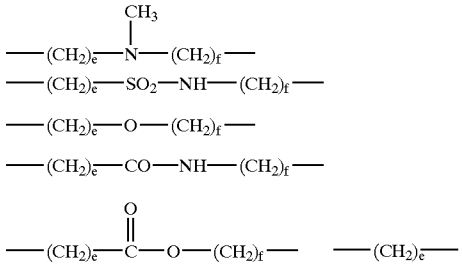

e and f = 1–30, with the proviso that e + f ≤ 31 e and f=1–30, with the proviso that e+f≦31.

Q represents the atoms necessary to form a chromophore comprising an amidinium-ion, a carboxyl-ion or dipolar-amidic chromophoric system when conjugated with X—Y'. Preferably the chromophoric system is of the type generally found in cyanine, complex cyanine, hemicyanine, merocyanine, and complex merocyanine dyes as described in F. M. Hamer, *The Cyanine Dyes and Related Compounds* (Interscience Publishers, New York, 1964).

Illustrative Q groups include:

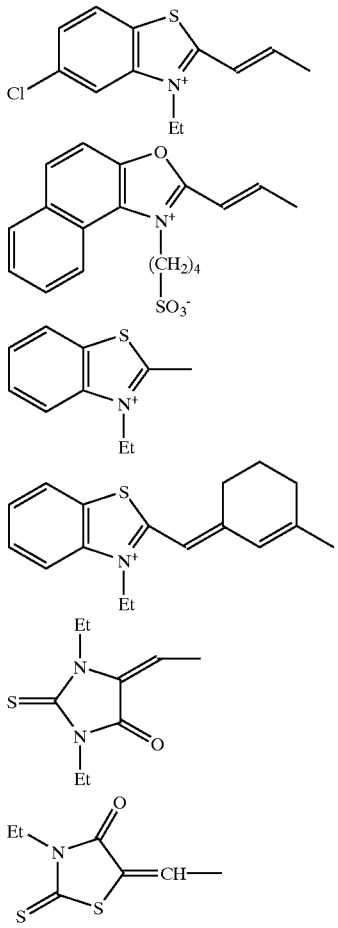

-continued

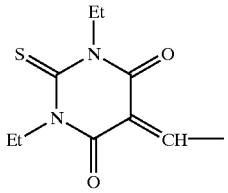

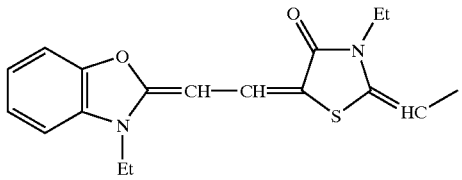

Particularly preferred are Q groups of the formula:

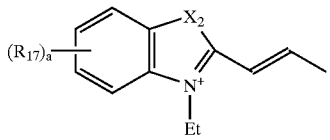

wherein:

$X_2$ is O, S, N, or $C(R_{19})_2$, where $R_{19}$ is substituted or unsubstituted alkyl.

each $R_{17}$ is independently a hydrogen atom, a halogen atom, a substituted or unsubstituted alkyl group, or substituted or unsubstituted aryl group;

a is an integer of 1–4; and $R_{18}$ is substituted or unsubstituted alkyl, or substituted or unsubstituted aryl.

Illustrative fragmentable electron donating compounds include:

FED 1

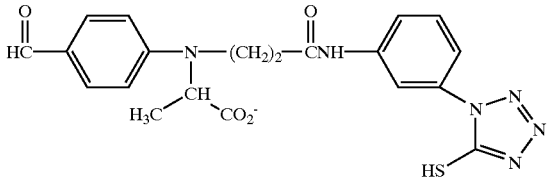

FED 2

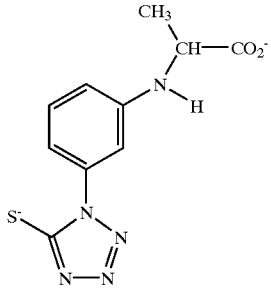

FED 3

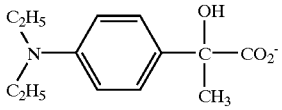

FED 4

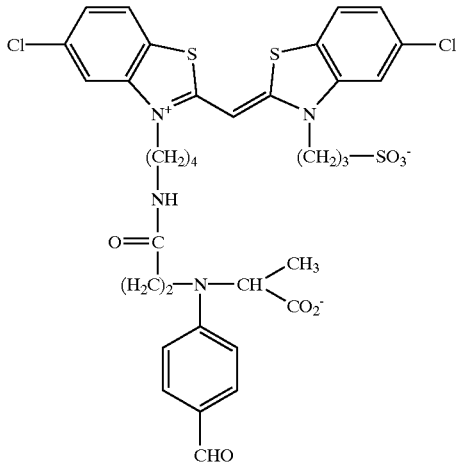

FED 5

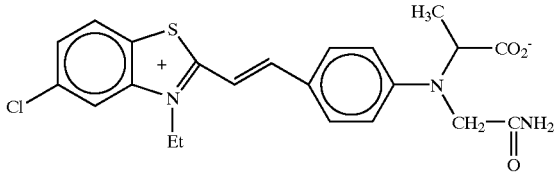

FED 6

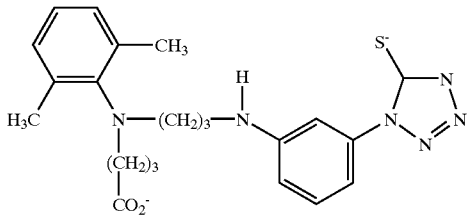

-continued
FED 7
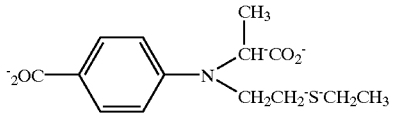
FED 8
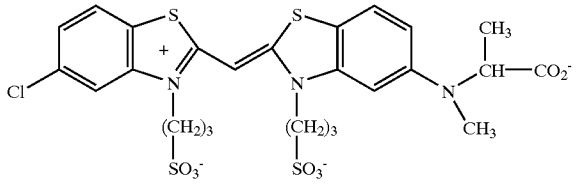
FED 9
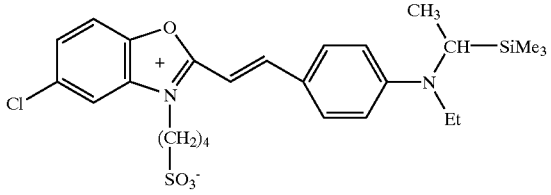
FED 10
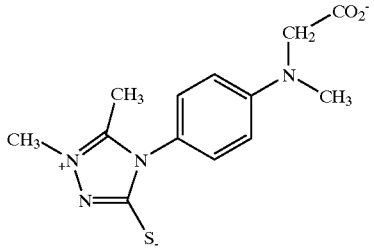
FED 11
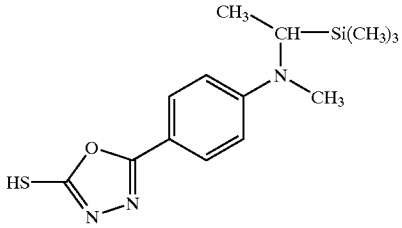
FED 12
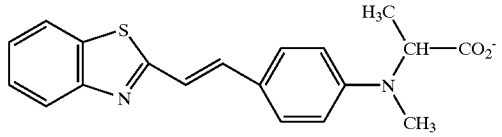
FED 13
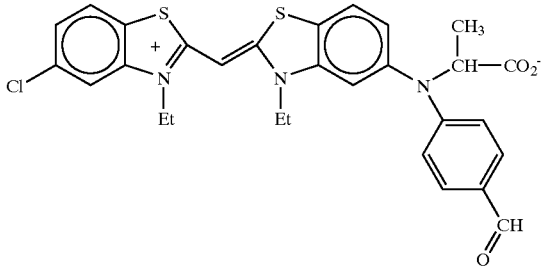
FED 14
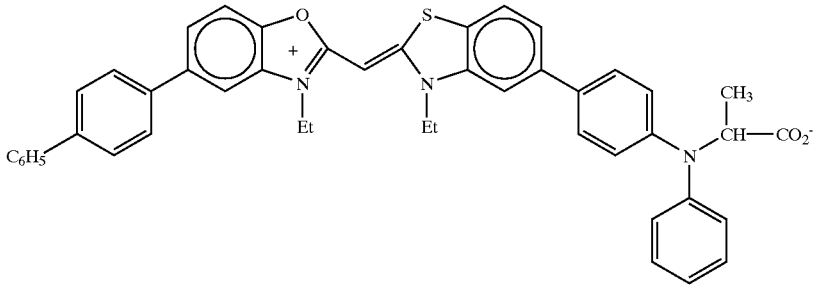

-continued
FED 15
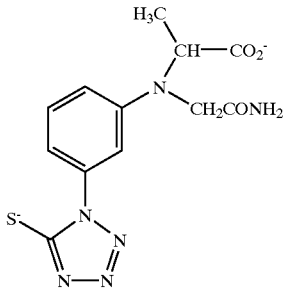
FED 16
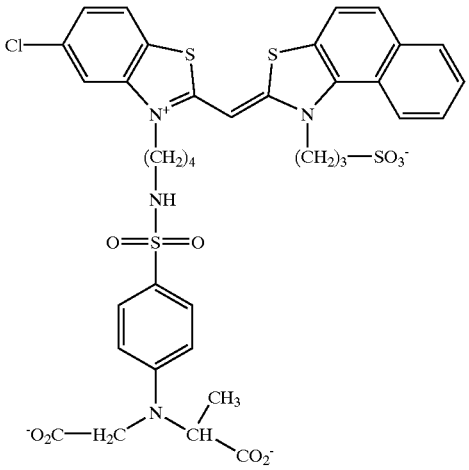
FED 18
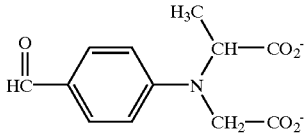
FED 19
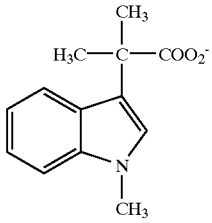
FED 20
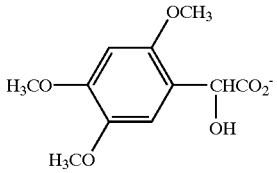
FED 21
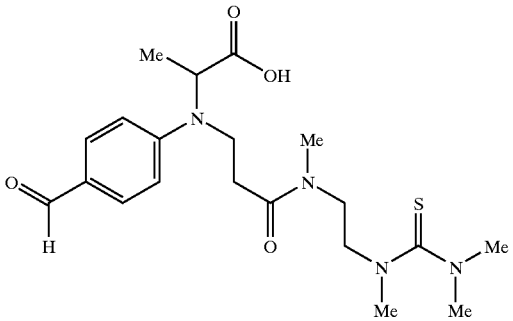
FED 22
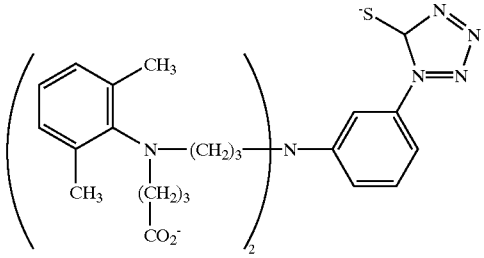
FED 23
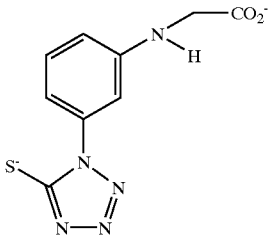

-continued

FED 24

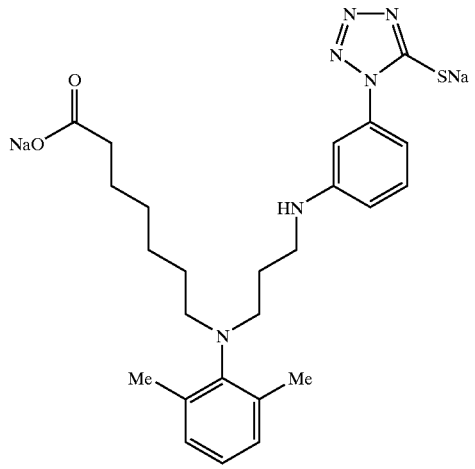

The fragmentable electron donors of the present invention can be included in a silver halide emulsion by direct dispersion in the emulsion, or they may be dissolved in a solvent such as water, methanol or ethanol for example, or in a mixture of such solvents, and the resulting solution can be added to the emulsion. The compounds of the present invention may also be added from solutions containing a base and/or surfactants, or may be incorporated into aqueous slurries or gelatin dispersions and then added to the emulsion. The fragmentable electron donor may be used as the sole sensitizer in the emulsion. However, in preferred embodiments of the invention a sensitizing dye is also added to the emulsion. The compounds can be added before, during or after the addition of the sensitizing dye. The amount of electron donor which is employed in this invention may range from as little as $1\times10^{-9}$ mole per mole of silver in the emulsion to as much as about 0.1 mole per mole of silver, preferably from about $5\times10^{-9}$ to about 0.05 mole per mole of silver. Where the oxidation potential $E_1$ for the XY moiety of the electron donating sensitizer is a relatively low potential, it is more active, and relatively less agent need be employed. Conversely, where the oxidation potential for the XY moiety of the electron donating sensitizer is relatively high, a larger amount thereof, per mole of silver, is employed. In addition, for XY moieties that have silver halide adsorptive groups A or light absorptive groups Z or chromophoric groups Q directly or indirectly attached to X, the fragmentable electron donating sensitizer is more closely associated with the silver halide grain and relatively less agent need be employed. Although it is preferred that the fragmentable electron donor be added to the silver halide emulsion prior to manufacture of the coating, in certain instances, the electron donor can also be incorporated into the emulsion after exposure by way of a pre-developer bath or by way of the developer bath itself.

Fragmentable electron donating compounds are described more fully in U.S. Pat. Nos. 5,747,235, 5,747,236, 5,994,051, 6,010,841, 6,054,269, and 6,153,371, the entire disclosures of these patents are incorporated herein by reference.

Various compounds may be added to the photographic material of the present invention for the purpose of lowering the fogging of the material during manufacture, storage, or processing. Typical antifoggants are discussed in Section VI of *Research Disclosure* September 1996, Number 389, Item 38957, which will be identified hereafter by the term "*Research Disclosure I*." This and all other Research Disclosures referenced herein are published by Kenneth Mason Publications, Ltd., Dudley Annex, 12a North Street, Emsworth, Hampshire P010 7DQ, ENGLAND. The Sections hereafter referred to are Sections of the *Research Disclosure I* unless otherwise indicated. Such antifoggants include, for example, tetraazaindenes, mercaptotetrazoles, polyhydroxybenzenes, hydroxyaminobenzenes, combinations of a thiosulfonate and a sulfinate, and the like.

For this invention, polyhydroxybenzene and hydroxyaminobenzene compounds (hereinafter "hydroxybenzene compounds") are preferred as they are effective for lowering fog without decreasing the emulsion sensitvity. Examples of hydroxybenzene compounds are:

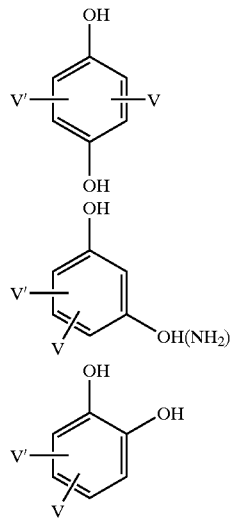

In these formulae, V and V' each independently represent —H, —OH, a halogen atom, —OM (M is alkali metal ion), an alkyl group, a phenyl group, an amino group, a carbonyl group, a sulfone group, a sulfonated phenyl group, a sulfonated alkyl group, a sulfonated amino group, a carboxyphenyl group, a carboxyalkyl group, a carboxyamino group, a hydroxyphenyl group, a hydroxyalkyl group, an alkylether group, an alkylphenyl group, an alkylthioether group, or a phenylthioether group.

More preferably, they each independently represent —H, —OH, —Cl, —Br, —COOH, —$CH_2CH_2COOH$, —$CH_3$, —$CH_2CH_3$, —$C(CH_3)_3$, —$OCH_3$, —CHO, —$SO_3K$, —$SO_3Na$, —$SO_3H$, —$SCH_3$, or -phenyl.

Especially preferred hydroxybenzene compounds follow:

HB1

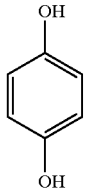

HB2

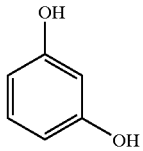

HB3

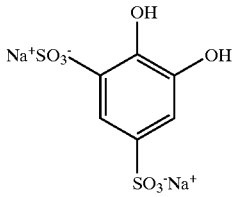

HB4

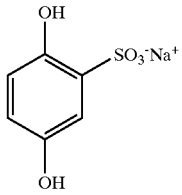

HB5

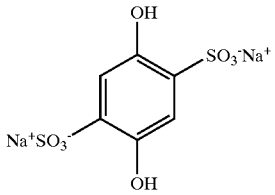

HB6

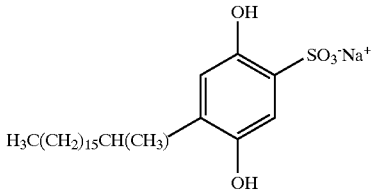

HB7

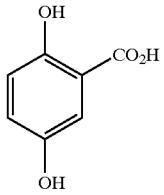

-continued

HB8

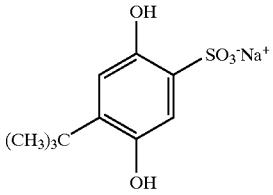

HB9

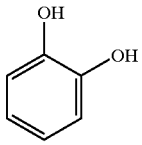

HB10

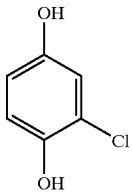

HB11

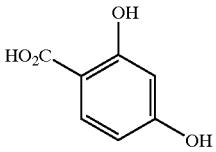

HB12

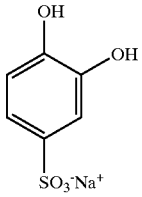

HB13

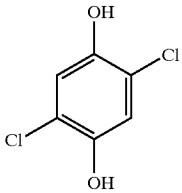

HB14

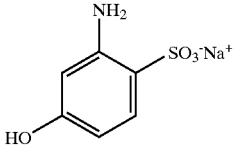

HB15

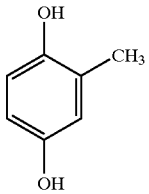

Hydroxybenzene compounds may be added to the emulsion layers or any other layers constituting the photographic material of the present invention. The preferred amount added is from $1\times10^{-3}$ to $1\times10^{-1}$ mol, and more preferred is $1\times10^{-3}$ to $2\times10^{-2}$ mol, per mol of silver halide.

The reductones utilized in the invention can be represented by the formula 2:

2

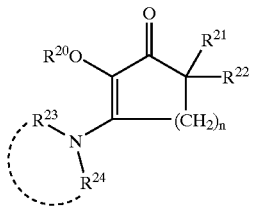

wherein $R^{23}$ and $R^{24}$ are the same or different, and may represent H, alkyl, cycloalkyl, aryl, or an alkyl group with a solubilizing group, such as —OH, sulfonamide, sulfamoyl, or carbamoyl, or $R^{23}$ and $R^{24}$ may be joined to complete a heterocyclic ring, such as aziridinyl, azetidinyl, pyrrolidinyl, piperidinyl, morpholinyl, piperazinyl, or pyridinyl, $R^{21}$ and $R^{22}$ are H, OH, alkyl, aryl, cycloalkyl, or may together represent an alkylidene group, n is 1 or 2 and $R^{20}$ is H, alkyl, aryl, or $CO_2R^{25}$ where $R^{25}$ is alkyl.

In one preferred embodiment $R^{20}$ is hydrogen, $R^{21}$ is —OH, $R^{22}$ is methyl, and n is 1. In another preferred embodiment $R^{23}$ and $R^{24}$ complete a morpholino ring or $R^{23}$ and $R^{24}$ are methyl, and $R^{20}$ is hydrogen, $R^{21}$ is —OH, $R^{22}$ is methyl, and n is 1. These structures are represented by preferred compounds R-1 to R-17 below.

R-1

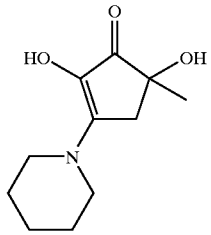

R-2

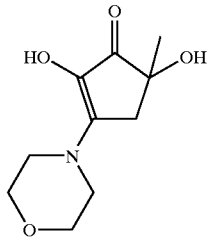

R-3

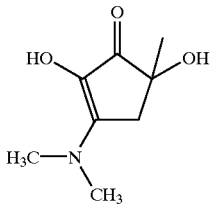

-continued

R-4

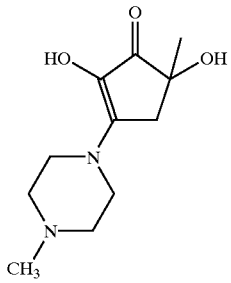

R-5

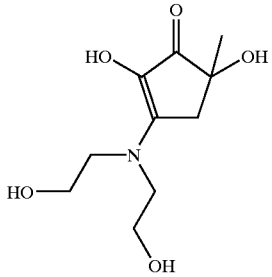

R-6

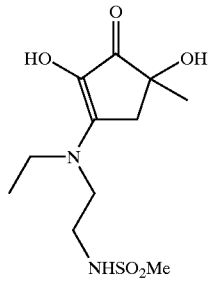

R-7

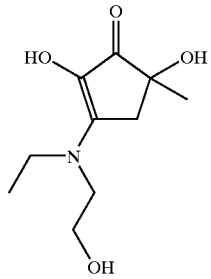

R-8

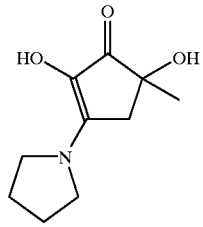

R-9

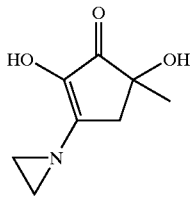

-continued

R-10

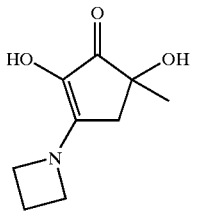

R-11

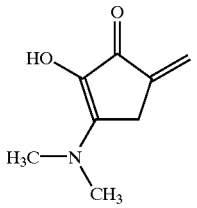

R-12

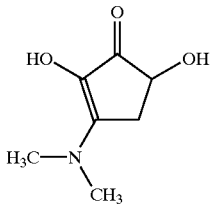

R-13

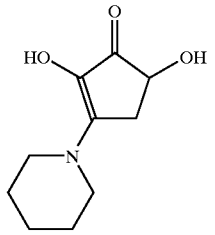

R-14

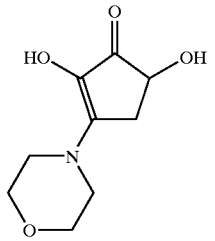

R-15

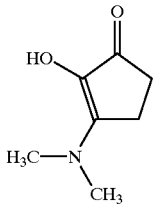

R-16

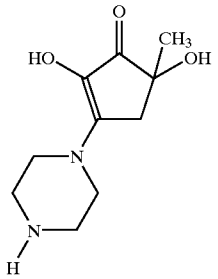

-continued

R-17

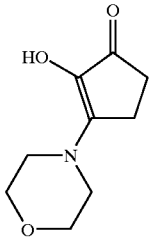

R-18

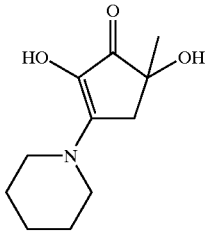

The reductone may be utilized in any amount that is effective to improve latent image keeping and raw stock keeping. Generally an amount between about 0.002 and 200 micromoles/$m^2$ is suitable. A preferred amount has been found to be between about 10 and 100 micromoles/$m^2$ to provide the most effective and economical improvement in raw stock keeping while maintaining speed and low fog.

The reductones used in the invention can be prepared by the acid catalyzed condensation of D-glucose with amines, for example, as described in U.S. Pat. No. 2,936,308, the entire disclosures of which are incorporated herein by reference The reductones can be prepared directly, or they may be obtained from the intermediate glycosylamines by heating.

In one embodiment the logarithm of the partition coefficient for the reductone when equilibrated as a solute between n-octanol and water (logP) is less than 0.293. A preferred partition coefficient for the reductone when it equilibrated as a solute between n-octanol and water (logP) is between 0.293 and −1.0 for good solubility and raw stock keeping improvement.

The reductone of the invention may be added to any layer in the photographic element. The reductone tends to move between the layers during formation of the photographic element and therefore, the layer of addition is less critical. It has been found satisfactory to add the reductone to the yellow coupler dispersion utilized in the blue sensitive layer. The reductone may suitably be added to the coupler dispersion or to the emulsion prior to coating. Further, it may be added immediately prior to coating of the layers of the photographic element. A preferred place of addition has been found to be into the coupler dispersion prior to its being combined with the silver halide grains of the emulsion, as this provides a keeping improvement with minimal effect on the initial speed and fog of the silver halide grains.

The emulsion layer of the photographic element of the invention can comprise any one or more of the light sensitive layers of the photographic element. The photographic elements made in accordance with the present invention are multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

Photographic elements of the present invention may also usefully include a magnetic recording material as described in *Research Disclosure*, Item 34390, November 1992, or a transparent magnetic recording layer such as a layer containing magnetic particles on the underside of a transparent support as in U.S. Pat. No. 4,279,945 and U.S. Pat. No. 4,302,523. The element typically will have a total thickness (excluding the support) of from 5 to 30 microns. While the order of the color sensitive layers can be varied, they will normally be red-sensitive, green-sensitive and blue-sensitive, in that order on a transparent support, (that is, blue sensitive furthest from the support) and the reverse order on a reflective support being typical.

The present invention also contemplates the use of photographic elements of the present invention in what are often referred to as single use cameras (or "film with lens" units). These cameras are sold with film preloaded in them and the entire camera is returned to a processor with the exposed film remaining inside the camera. Such cameras may have glass or plastic lenses through which the photographic element is exposed.

The photographic elements of the present invention may also use colored couplers (e.g. to adjust levels of interlayer correction) and masking couplers such as those described in EP 213 490; Japanese Published Application 58-172,647; U.S. Pat. No. 2,983,608; German Application DE 2,706,117C; U.K. Patent 1,530,272; Japanese Application A-113935; U.S. Pat. No. 4,070,191 and German Application DE 2,643,965. The masking couplers may be shifted or blocked.

The photographic elements may also contain materials that accelerate or otherwise modify the processing steps of bleaching or fixing to improve the quality of the image. Bleach accelerators described in EP 193 389; EP 301 477; U.S. Pat. No. 4,163,669; U.S. Pat. No. 4,865,956; and U.S. Pat. No. 4,923,784 are particularly useful. Also contemplated is the use of nucleating agents, development accelerators or their precursors (UK Patent 2,097,140; U.K. Patent 2,131,188); development inhibitors and their precursors (U.S. Pat. No. 5,460,932; U.S. Pat. No. 5,478,711); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol or yellow and/or magenta filter dyes and/or antihalation dyes (particularly in an undercoat beneath all light sensitive layers or in the side of the support opposite that on which all light sensitive layers are located) either as oil-in-water dispersions, latex dispersions or as solid particle dispersions. Additionally, they may be used with "smearing" couplers (e.g. as described in U.S. Pat. No. 4,366,237; EP 096 570; U.S. Pat. No. 4,420,556; and U.S. Pat. No. 4,543,323.) Also, the couplers may be blocked or coated in protected form as described, for example, in Japanese Application 61/258,249 or U.S. Pat. No. 5,019,492.

The photographic elements may further contain other image-modifying compounds such as "Development Inhibitor-Releasing" compounds (DIR's). Useful additional DIR's for elements of the present invention, are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

DIR compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference.

The silver halide emulsions can contain grains of any size and morphology. Thus, the grains may take the form of cubes, octahedrons, cubo-octahedrons, or any of the other naturally occurring morphologies of cubic lattice type silver halide grains. Further, the grains may be irregular such as spherical grains or tabular grains.

Especially useful in this invention are tabular grain silver halide emulsions. Tabular grains are those having two parallel major crystal faces and having an aspect ratio of at least 2. The term "aspect ratio" is the ratio of the equivalent circular diameter (ECD) of a grain major face divided by its thickness (t). Tabular grain emulsions are those in which the tabular grains account for at least 50 percent (preferably at least 70 percent and optimally at least 90 percent) of the total grain projected area. Preferred tabular grain emulsions are those in which the average thickness of the tabular grains is less than 0.3 micrometer (preferably thin—that is, less than 0.2 micrometer. The major faces of the tabular grains can lie in either {111} or {100} crystal planes. The mean ECD of tabular grain emulsions rarely exceeds 10 micrometers and more typically is less than 5 micrometers.

In their most widely used form tabular grain emulsions are high bromide {111} tabular grain emulsions. Such emulsions are illustrated by Kofron et al U.S. Pat. No. 4,439,520, Wilgus et al U.S. Pat. No. 4,434,226, Solberg et al U.S. Pat. No. 4,433,048, Maskasky U.S. Pat. Nos. 4,435,501, 4,463,087 and 4,173,320, Daubendiek et al U.S. Pat. Nos. 4,414,310 and 4,914,014, Sowinski et al U.S. Pat. No. 4,656,122, Piggin et al U.S. Pat. Nos. 5,061,616 and 5,061,609, Tsaur et al U.S. Pat. Nos. 5,147,771, '772, '773, 5,171,659 and 5,252,453, Black et al U.S. Pat. Nos. 5,219,720 and 5,334,495, Delton U.S. Pat. Nos. 5,310,644, 5,372,927 and 5,460,934, Wen U.S. Pat. No. 5,470,698, Fenton et al U.S. Pat. No. 5,476,760, Eshelman et al U.S. Pat. Nos. 5,612,175 and 5,614,359, and Irving et al U.S. Pat. No. 5,667,954.

Ultrathin high bromide {111} tabular grain emulsions are illustrated by Daubendiek et al U.S. Pat. Nos. 4,672,027, 4,693,964, 5,494,789, 5,503,971 and 5,576,168, Antoniades et al U.S. Pat. No. 5,250,403, Olm et al U.S. Pat. No. 5,503,970, Deaton et al U.S. Pat. No. 5,582,965, and Maskasky U.S. Pat. No. 5,667,955. High bromide {100} tabular grain emulsions are illustrated by Mignot U.S. Pat. Nos. 4,386,156 and 5,386,156.

High chloride {111} tabular grain emulsions are illustrated by Wey U.S. Pat. No. 4,399,215, Wey et al U.S. Pat. No. 4,414,306, Maskasky U.S. Pat. Nos. 4,400,463, 4,713,323, 5,061,617, 5,178,997, 5,183,732, 5,185,239, 5,399,478 and 5,411,852, and Maskasky et al U.S. Pat. Nos. 5,176,992 and 5,178,998. Ultrathin high chloride {111} tabular grain emulsions are illustrated by Maskasky U.S. Pat. Nos. 5,271,858 and 5,389,509.

High chloride {100} tabular grain emulsions are illustrated by Maskasky U.S. Pat. Nos. 5,264,337, 5,292,632, 5,275,930 and 5,399,477, House et al U.S. Pat. No. 5,320,938, Brust et al U.S. Pat. No. 5,314,798, Szajewski et al U.S. Pat. No. 5,356,764, Chang et al U.S. Pat. Nos. 5,413,904 and 5,663,041, Oyamada U.S. Pat. No. 5,593,821, Yamashita et al U.S. Pat. Nos. 5,641,620 and 5,652,088, Saitou et al U.S. Pat. No. 5,652,089, and Oyamada et al U.S. Pat. No. 5,665,530. Ultrathin high chloride {100} tabular grain emulsions can be prepared by nucleation in the presence of iodide, following the teaching of House et al and Chang et al, cited above.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent. Tabular grain emulsions of the latter type are illustrated by Evans et al. U.S. Pat. No. 4,504,570. Photographic elements can be exposed to actinic radiation, typically in the visible region of the spectrum, to form a latent image and can then be processed to form a visible dye image as already described above.

In the course of grain precipitation one or more dopants (grain occlusions other than silver and halide) can be introduced to modify grain properties. For example, any of the various conventional dopants disclosed in *Research Disclosure*, Item 36544, Section I. Emulsion grains and their preparation, sub-section G. Grain modifying conditions and adjustments, paragraphs (3), (4) and (5), can be present in the emulsions of the invention. Doping with selenium or with selenium and iridium as described in Johnson and Wightman U.S. Pat. No. 5,164,292 may be particularly beneficial. In addition it is specifically contemplated to dope the grains with transition metal hexacoordination complexes containing one or more organic ligands, as taught by Olm et al U.S. Pat. No. 5,360,712, the disclosure of which is here incorporated by reference.

It is specifically contemplated to incorporate in the face centered cubic crystal lattice of the grains a dopant capable of increasing imaging speed by forming a shallow electron trap (hereinafter also referred to as a SET) as discussed in Research Discolosure Item 36736 published November 1994, here incorporated by reference.

The SET dopants are effective at any location within the grains. Generally better results are obtained when the SET dopant is incorporated in the exterior 50 percent of the grain, based on silver. An optimum grain region for SET incorporation is that formed by silver ranging from 50 to 85 percent of total silver forming the grains. The SET can be introduced all at once or run into the reaction vessel over a period of time while grain precipitation is continuing. Generally SET forming dopants are contemplated to be incorporated in concentrations of at least $1\times10^{-7}$ mole per silver mole up to their solubility limit, typically up to about $5\times10^{-4}$ mole per silver mole.

SET dopants are known to be effective to reduce reciprocity failure. In particular the use of iridium hexacoordination complexes or $Ir^{+4}$ complexes as SET dopants is advantageous.

Iridium dopants that are ineffective to provide shallow electron traps (non-SET dopants) can also be incorporated into the grains of the silver halide grain emulsions to reduce reciprocity failure. To be effective for reciprocity improvement the Ir can be present at any location within the grain structure. A preferred location within the grain structure for Ir dopants to produce reciprocity improvement is in the region of the grains formed after the first 60 percent and before the final 1 percent (most preferably before the final 3 percent) of total silver forming the grains has been precipitated. The dopant can be introduced all at once or run into the reaction vessel over a period of time while grain precipitation is continuing. Generally reciprocity improving non-SET Ir dopants are contemplated to be incorporated at their lowest effective concentrations.

Although generally preferred concentration ranges for the various SET and non-SET Ir dopants have been set out above, it is recognized that specific optimum concentration ranges within these general ranges can be identified for specific applications by routine testing. It is specifically contemplated to employ the SET and non-SET Ir dopants singly or in combination. For example, grains containing a combination of an SET dopant and a non-SET Ir dopant are specifically contemplated.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), deionized gelatin, gelatin derivatives (e.g., acetylated gelatin, phthalated gelatin, and the like), and others as described in *Research Disclosure I*. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I*. The vehicle can be present in the emulsion in any amount useful in photographic emulsions. The emulsion can also include any of the addenda known to be useful in photographic emulsions.

The silver halide to be used in the invention may be advantageously subjected to chemical sensitization. Compounds and techniques useful for chemical sensitization of silver halide are known in the art and described in *Research Disclosure I* and the references cited therein. Compounds useful as chemical sensitizers, include, for example, active gelatin, sulfur, selenium, tellurium, gold, platinum, palladium, iridium, osmium, rhenium, phosphorous, or combinations thereof Chemical sensitization is generally carried out at pAg levels of from 5 to 10, pH levels of from 4 to 8, and temperatures of from 30 to 80° C., as described in *Research Disclosure I*, Section IV (pages 510–511) and the references cited therein.

The silver halide may be sensitized by sensitizing dyes by any method known in the art, such as described in *Research Disclosure I*. The dye may be added to an emulsion of the silver halide grains and a hydrophilic colloid at any time prior to (e.g., during or after chemical sensitization) or simultaneous with the coating of the emulsion on a photographic element. The dyes may, for example, be added as a solution in water or an alcohol. The dye/silver halide emulsion may be mixed with a dispersion of color image-forming coupler immediately before coating or in advance of coating (for example, 2 hours). Typical sensitizing dyes for use with fragmentable electron donors are described in U.S. Pat. No. 5,747,236, incorporated herein by reference.

Photographic elements of the present invention are preferably imagewise exposed using any of the known techniques, including those described in *Research Disclosure I*, section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like). Where photographic elements of the present invention are intended as duplicating films or as print materials, the exposure is typically made by passing light in the visible region through a color negative or positive image and appropriate focussing lenses.

Photographic elements comprising the composition of the invention can be processed in any of a number of well-known photographic processes utilizing any of a number of well-known processing compositions, described, for example, in *Research Disclosure I*, or in T. H. James, editor, The *Theory of the Photographic Process*, 4th Edition, Macmillan, New York, 1977. In the case of processing a negative working color element, the element is treated with a color developer (that is one which will form the colored image dyes with the color couplers), and then with a oxidizer and a solvent to remove silver and silver halide. In the case of processing a reversal color element, the element is first treated with a black and white developer (that is, a developer which does not form colored dyes with the coupler compounds) followed by a treatment to fog silver halide (usually chemical fogging or light fogging), followed by treatment with a color developer. Preferred color developing agents are p-phenylenediamines. Especially preferred are:

4-amino N,N-diethylaniline hydrochloride, 4-amino-3-methyl-N,N-diethylaniline hydrochloride, 4-amino-3-methyl-N-ethyl-N-(β-(methanesulfonamido) ethylaniline sesquisulfate hydrate, 4-amino-3-methyl-N-ethyl-N-(β-hydroxyethyl)aniline sulfate, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

Dye images can be formed or amplified by processes which employ in combination with a dye-image-generating reducing agent an inert transition metal-ion complex oxidizing agent, as illustrated by Bissonette U.S. Pat. Nos. 3,748,138, 3,826,652, 3,862,842 and 3,989,526 and Travis U.S. Pat. No. 3,765,891, and/or a peroxide oxidizing agent as illustrated by Matejec U.S. Pat. No. 3,674,490, *Research Disclosure*, Vol. 116, December, 1973, Item 11660, and Bissonette *Research Disclosure*, Vol. 148, August, 1976, Items 14836, 14846 and 14847. The photographic elements can be particularly adapted to form dye images by such processes as illustrated by Dunn et al U.S. Pat. No. 3,822,129, Bissonette U.S. Pat. Nos. 3,834,907 and 3,902,905, Bissonette et al U.S. Pat. No. 3,847,619, Mowrey U.S. Pat. No. 3,904,413, Hirai et al U.S. Pat. No. 4,880,725, Iwano U.S. Pat. No. 4,954,425, Marsden et al U.S. Pat. No. 4,983,504, Evans et al U.S. Pat. No. 5,246,822, Twist U.S. Pat. No. 5,324,624, Fyson EPO 0 487 616, Tannahill et al WO 90/13059, Marsden et al WO 90/13061, Grimsey et al WO 91/16666, Fyson WO 91/17479, Marsden et al WO 92/01972. Tannahill WO 92/05471, Henson WO 92/07299, Twist WO 93/01524 and WO 93/11460 and Wingender et al German OLS 4,211,460.

Color development is usually followed by the conventional steps of bleaching, fixing, or bleach-fixing, to remove silver or silver halide, washing, and drying. The photographic elements of this invention may be processed utilizing either conventional processing systems, described above or low volume processing systems.

Low volume systems are those where film processing is initiated by contact to a processing solution, but where the processing solution volume is comparable to the total volume of the imaging layer to be processed. This type of system may include the addition of non-solution processing aids, such as the application of heat or of a laminate layer that is applied at the time of processing. Conventional photographic systems are those where film elements are processed by contact with conventional photographic processing solutions, and the volume of such solutions is very large in comparison to the volume of the imaging layer.

Low volume processing is defined as processing where the volume of applied developer solution is between about 0.1 to about 10 times, preferably about 0.5 to about 10 times, the volume of solution required to swell the photographic element. This processing may take place by a combination of solution application, external layer lamination, and heating. The low volume system photographic element may receive some or all of the following treatments:

(I) Application of a solution directly to the film by any means, including spray, inkjet, coating, gravure process and the like.

(II) Soaking of the film in a reservoir containing a processing solution. This process may also take the form of dipping or passing an element through a small cartridge.

(III) Lamination of an auxiliary processing element to the imaging element. The laminate may have the purpose of providing processing chemistry, removing spent chemistry, or transferring image information from the latent image recording film element. The transferred image may result from a dye, dye precursor, or silver containing compound being transferred in a imagewise manner to the auxiliary processing element.

(IV) Heating of the element by any convenient means, including a simple hot plate, iron, roller, heated drum, microwave heating means, heated air, vapor, or the like. Heating may be accomplished before, during, after, or throughout any of the preceding treatments I–III. Heating may cause processing temperatures ranging from room temperature to 100° C.

Photographic elements and methods of processing such elements particularly suitable for use with this invention are described in *Research Disclosure*, February 1995, Item 37038, incorporated herein by reference.

The processed photographic elements of this invention may serve as origination material for some or all of the following processes: image scanning to produce an electronic rendition of the capture image, and subsequent digital processing of that rendition to manipulate, store, transmit, output, or display electronically that image. A number of modifications of color negative elements have been suggested for accommodating scanning, as illustrated by *Research Disclosure, I* Section XIV. Scan facilitating features *Research Disclosure*, and *Research Disclosure* September 1994, Item 36544. These systems are contemplated for use in the practice of this invention. Further examples of such processes and useful film features are also described in U.S. Pat. No. 5,840,470; U.S. Pat. No. 6,045,938; U.S. Pat. No. 6,021,277; EP 961,482 and EP905,651.

For example, it is possible to scan the photographic element successively within the blue, green, and red regions of the spectrum or to incorporate blue, green, and red light within a single scanning beam that is divided and passed through blue, green, and red filters to form separate scanning beams for each color record. A simple technique is to scan the photographic element point-by-point along a series of laterally offset parallel scan paths. The intensity of light passing through the element at a scanning point is noted by a sensor, which converts radiation received into an electrical signal. Most generally this electronic signal is further manipulated to form a useful electronic record of the image. For example, the electrical signal can be passed through an analog-to-digital converter and sent to a digital computer together with location information required for pixel (point) location within the image. In another embodiment, this electronic signal is encoded with calorimetric or tonal information to form an electronic record that is suitable to allow reconstruction of the image into viewable forms such as computer monitor displayed images, television images, printed images, and so forth.

It is contemplated that many of imaging elements of this invention will be scanned prior to the removal of silver halide from the element. The remaining silver halide yields a turbid coating, and it is found that improved scanned image quality for such a system can be obtained by the use of scanners that employ diffuse illumination optics. Any technique known in the art for producing diffuse illumination can be used. Preferred systems include reflective systems, that employ a diffusing cavity whose interior walls are specifically designed to produce a high degree of diffuse reflection, and transmissive systems, where diffusion of a beam of specular light is accomplished by the use of an optical element placed in the beam that serves to scatter light. Such elements can be either glass or plastic that either incorporate a component that produces the desired scattering, or have been given a surface treatment to promote the desired scattering.

One of the challenges encountered in producing images from information extracted by scanning is that the number of pixels of information available for viewing is only a fraction of that available from a comparable classical photographic print. It is, therefore, even more important in scan imaging to maximize the quality of the image information available. Enhancing image sharpness and minimizing the impact of aberrant pixel signals (i.e., noise) are common approaches to enhancing image quality. A conventional technique for minimizing the impact of aberrant pixel signals is to adjust each pixel density reading to a weighted average value by factoring in readings from adjacent pixels, closer adjacent pixels being weighted more heavily. The elements of the invention can have density calibration patches derived from one or more patch areas on a portion of unexposed photographic recording material that was subjected to reference exposures, as described by Wheeler et al U.S. Pat. No. 5,649,260, Koeng at al U.S. Pat. No. 5,563,717, Cosgrove et al U.S. Pat. No. 5,644,647, and Reem and Sutton U.S. Pat. No. 5,667,944.

Illustrative systems of scan signal manipulation, including techniques for maximizing the quality of image records, are disclosed by Bayer U.S. Pat. No. 4,553,156; Urabe et al U.S. Pat. No. 4,591,923; Sasaki et al U.S. Pat. No. 4,631,578; Alkofer U.S. Pat. No. 4,654,722; Yamada et al U.S. Pat. No. 4,670,793; Klees U.S. Pat. Nos. 4,694,342 and 4,962,542; Powell U.S. Pat. No. 4,805,031; Mayne et al U.S. Pat. No. 4,829,370; Abdulwahab U.S. Pat. No. 4,839,721; Matsunawa et al U.S. Pat. Nos. 4,841,361 and 4,937,662; Mizukoshi et al U.S. Pat. No. 4,891,713; Petilli U.S. Pat. No. 4,912,569; Sullivan et al U.S. Pat. Nos. 4,920,501 and 5,070,413; Kimoto et al U.S. Pat. No. 4,929,979; Hirosawa et al U.S. Pat. No. 4,972,256; Kaplan U.S. Pat. No. 4,977,521; Sakai U.S. Pat. No. 4,979,027; Ng U.S. Pat. No. 5,003,494; Katayama et al U.S. Pat. No. 5,008,950; Kimura et al U.S. Pat. No. 5,065,255; Osamu et al U.S. Pat. No. 5,051,842; Lee et al U.S. Pat. No. 5,012,333; Bowers et al U.S. Pat. No. 5,107,346; Telle U.S. Pat. No. 5,105,266; MacDonald et al U.S. Pat. No. 5,105,469; and Kwon et al U.S. Pat. No. 5,081,692. Techniques for color balance adjustments during scanning are disclosed by Moore et al U.S. Pat. No. 5,049,984 and Davis U.S. Pat. No. 5,541,645. Color image reproduction of scenes with color enhancement and preferential tone-scale mapping are described by Burh et al. in U.S. Pat. Nos. 5,300,381 and 5,528,339.

The digital color records once acquired are in most instances adjusted to produce a pleasingly color balanced image for viewing and to preserve the color fidelity of the image bearing signals through various transformations or renderings for outputting, either on a video monitor or when printed as a conventional color print. Preferred techniques for transforming image bearing signals after scanning are disclosed by Giorgianni et al U.S. Pat. No. 5,267,030, the disclosures of which are herein incorporated by reference. The signal transformation techniques of Giorgianni et al '030 described in connection with FIG. 8 represent a specifically preferred technique for obtaining a color balanced image for viewing. Further illustrations of the capability of those skilled in the art to manage color digital image information are provided by Giorgianni and Madden *Digital Color Management*, Addison-Wesley, 1998.

The following examples illustrate the preparation and evaluation of photographic elements of the invention.

EXAMPLES

Example 1

Emulsion E-1

An AgBrI tabular silver halide emulsion (Emulsion E-1) was prepared containing 4.1% total iodide distributed such that the central portion of the emulsion grains contained 1.1% iodide and the perimeter area contained substantially higher iodide as described by Chang et. al., U.S. Pat. No. 5,314,793. The emulsion grains had an average thickness of 0.13 $\mu$m and average circular diameter of 2.7 $\mu$m. The emulsion was precipitated using deionized gelatin and contained 0.2 mg KSeCN per silver mole introduced at 80% of the precipitation and 0.012 mg $K_2IrCl_6$ per Ag mole introduced at approximately 80%. The emulsion was optimally chemically and spectrally sensitized by adding NaSCN, $4\times10^{-4}$ mole/mole Ag of the Blue sensitizing dye BSD-1, $4\times10^{-4}$ mole/mole Ag of the Blue sensitizing dye BSD-2, $Na_3Au(S_2O_3)_2.2H_2O$, $Na_2S_2O_3.5H_2O$ and a benzothiazolium finish modifier. The emulsion was then subjected to a heat cycle to 60° C. The antifoggant-stabilizer, tetraazaindene, at a concentration of $1.02\times10^{-2}$ mole/mole silver, was added to the emulsion melt after the chemical sensitization procedure.

Multilayer (ML) film examples demonstrating the principles of this invention were produced by coating on cellulose triacetate (coverages are in grams per meter squared unless otherwise stated, emulsion sizes are reported in Diameter×Thickness in microns). Layers are numbered beginning with the layer closest to the support. Structures for compounds are given at the end of the example section. Variations of emulsion E-1 with FED-2 and reductones were coated in layer 10, the experimental layer.

ML-Sample A1:

Layer 1 (Antihalation layer): black colloidal silver sol at 0.172; OxDS-1 at 0.135, ADD-1 at 0.001; ADD-2 at 0.001; ADD-3 at 0.055; and gelatin at 2.05.

Layer 2 (Slow cyan layer): a blend of two red sensitized (both with a mixture of RSD-1 and RSD-2) tabular silver iodobromide emulsions: (i) 1.0×0.09 microns, 4.1 mole % I at 0.323 (ii) 0.55×0.08 micron, 1.5 mole % I at 0.431; cyan dye-forming coupler CC-1 at 0.535; bleach accelerator releasing coupler B-1 at 0.089; masking coupler CM-1 at 0.03; ADD-6 at 1.8 g/mol silver and gelatin at 2.024

Layer 3 (Mid cyan layer): a red sensitized (as above)tabular silver iodobromide emulsion: (i) 1.25×0.12 micron, 4.1 mole % I at 0.883; cyan coupler CC-1 at 0.105; IR-7 at 0.093; CM-1 at 0.018; ADD-6 at 1.8 g/mol silver and gelatin at 1.012

Layer 4 (Fast cyan layer): a red sensitized (same as above) tabular silver iodobromide emulsion (2.2×0.13 micron, 4.1 mole % I) at 1.076; CC-1 at 0.120; IR-7 at 0.019; CM-1 at 0.032; ADD-6 at 1.8 g/mol silver; ADD-7 at 0.05 mg/mol silver and gelatin at 1.270

Layer 5 (Interlayer): OxDS-1 at 0.075; ADD-9 at 0.002; and gelatin at 0.700.

Layer 6 (Slow magenta layer): a blend of two green sensitized (both with a mixture of GSD-1 and GSD-2) silver iodobromide emulsions: (i) 1.0×0.08 micron, 4.1 mole % iodide at 0.237 and (ii) 0.55×0.08 micron, 1.5 mole % iodide at 0.431; magenta dye forming coupler MC-1 at 0.299; MM-1 at 0.041; ADD-6 at 1.8 g/mol silver; OxDS-2 at 2.8 g/mole silver; and gelatin at 1.27

Layer 7 (Mid magenta layer): a green sensitized (same as above) tabular silver iodobromide emulsion 1.2×0.12 micron, 4.1 mole % I at 1.00; MC-1 at 0.82; MM-1 at 0.032; IR-6 at 0.024; OxDS-2 at 0.045; ADD-6 at 1.8 g/mol silver; ADD-7 at 0.05 mg/mol silver; and gelatin at 1.465.

Layer 8 (Fast magenta layer): a green sensitized tabular silver iodobromide (2.2×0.13 micron, 4.1 mole % I) emulsion at 1.044; MC-1 at 0.057; MM-1 at 0.043; IR-5 at 0.011; IR-4 at 0.011; OxDS-2 at 0.031; ADD-6 at 1.8 g/mol silver; ADD-7 at 0.1 mg/mol silver and gelatin at 1.251

Layer 9 (Yellow filter layer): yellow filter dye YFD-1 at 0.161; OxDS-1 at 0.075; ADD-9 at 0.002; and gelatin at 0.648.

Layer 10: (yellow layer) Emulsion E-1 at 1.076: HB3 at 0.004; ADD-6 at 1.8 g/mol silver and gelatin at 0.594.

Layer 10b: (yellow layer): yellow dye forming coupler YC-1 at 1.04; IR-1 at 0.075; B-1 at 0.022

(Layer 10a and 10b are mixed prior to coating)

Layer 11 (UV filter layer): silver bromide Lippman emulsion at 0.216; UV-2 at a total of 0.108; gelatin at 0.710, ADD-8 at 0.001, and 1,1'-(methylene bis(sulfonyl))bis-ethene hardener at 1.5% of total gelatin weight.

Layer 12(Protective Overcoat) Matte beads; gelatin at 0.888.

Surfactants, coating aids, emulsion addenda, sequestrants, thickeners, lubricants, matte and tinting dyes were added to the appropriate layers as is common in the art.

ML-A2 through A4 are like ML-A1 except prior to coating, FED-2 was added to layer 10a and reductones were to layer 10b as described in Table I.

Samples of each ML element were given a stepped exposure for 0.01 seconds to a light source with an effective color temperature of 5500 K and processed in the KODAK FLEXICOLOR (C-41) process as described in *British Journal of Photography Annual*, 1988, pp 196–198. Blue speed was measured in relative log units as (1-logH) where H is the exposure in lux-sec necessary to produce a yellow density 0.5 above Dmin. Relative speed was set equal to 1.00 for the multilayer element containing no FED compound.

Latent image keeping was measured by aging samples of each element for 3 weeks at 100° F. and 50% relative humidity (RH), then exposing the samples as described above, and then aging the samples for a further 1 week at 100° F. and 50% RH before processing the samples as described above. Latent image keeping speed changes were determined by comparing the blue speed obtained for these samples to the blue speed obtained for samples that were aged for 4 weeks at 100° F. and 50% RH before exposing and processing. Changes in yellow Dmin with keeping were obtained by comparing the Dmin obtained for samples that were aged for 4 weeks at 100° F. and 50% RH before exposing and processing to the Dmin obtained for samples that were held for 4 weeks at 0° F. and 50% RH before exposing and processing.

TABLE I

Fresh speed and keeping behavior for blue sensitive layer of multilayers with FED-2 and reductone compounds added

| ML | FED-2 added (mg/mole Ag) | Reductone added | Amount of Reductone (mg/ft2) | Fresh speed | Fresh Dmin | Change in speed with LIK | Change in Dmin with keeping |
|---|---|---|---|---|---|---|---|
| A1 | None | None | None | 1.00 | 0.85 | −0.14 | 0.01 |
| A2 | 0.4 | None | None | 1.32 | 0.87 | +0.02 | 0.09 |
| A3 | 0.4 | R-2 | 1.0 | 1.21 | 0.87 | +0.00 | 0.06 |
| A4 | 0.4 | R-3 | 0.8 | 1.09 | 0.87 | −0.05 | 0.03 |

The data in Table I show that addition of the FED compound FED-2 to the blue sensitized T-grain emulsion in the yellow layer gave a large increase in speed (ML A2 vs. ML A1). The latent image keeping for the layer was also improved from a significant speed loss to a small gain. However, the change in fog (Dmin) with keeping at 100 F increased significantly. Addition of the hexose reductone compound R-2 at a level of 1.0 mg/ft2 allowed most of the speed benefit and all of the latent image keeping benefit of FED-2 to be retained, while decreasing the high temperature keeping fog increase.(ML A3 vs. ML A2). Addition of the more active reductone, R-3, at a level of 0.8 mg/ft2, lowered both the fresh speed gain and the LIK benefit from FED-2 but substantially decreased the high temperature keeping fog (ML A4 vs. ML A2). It is expected that lowering the concentration of R-3 in the coating would allow for an optimized balance between fresh speed gain, LIK benefit, and high temperature keeping fog growth.

Example 2

Emulsion E-2

An AgBrI tabular silver halide emulsion (Emulsion E-2) was prepared containing 4.5% total iodide distributed such that the central portion of the emulsion grains contained no iodide and the perimeter area contained substantially higher iodide as described by Chang et. al., U.S. Pat. No. 5,314,793. The emulsion grains had an average thickness of 0.13 $\mu$m and average circular diameter of 1.3 $\mu$m. The emulsion was precipitated using oxidized gelatin and contained 0.2 mg KSeCN per silver mole introduced at approximately 70% of the precipitation and 0.003 mg $K_2IrCl$, per Ag mole introduced at approximately 65%. The emulsion was optimally chemically and spectrally sensitized by adding the antifoggant HB3, NaSCN, $8.0\times10^{-4}$ mole/mole Ag of the green sensitizing dye GSD-1, $2.0\times10^{-4}$ mole/mole Ag of the green sensitizing dye GSD-2, $Na_3Au(S_2O_3)_2.2H_2O$, $Na_2S_2O_3.5H_2O$ and a benzothiazolium finish modifier. The emulsion was then subjected to a heat cycle to 61° C. The antifoggant-stabilizer, tetraazaindene, at a concentration of $2.9\times10^{-3}$ mole/mole silver, was added to the emulsion melt after the chemical sensitization procedure.

Emulsion E-3

An AgBrI tabular silver halide emulsion (Emulsion E-3) was prepared containing 4.5% total iodide distributed such that the central portion of the emulsion grains contained no iodide and the perimeter area contained substantially higher iodide as described by Chang et. al., U.S. Pat. No. 5,314,793. The emulsion grains had an average thickness of 0.11 $\mu$m and average circular diameter of 0.65 $\mu$m. The emulsion was precipitated using oxidized gelatin and contained 0.2 mg KSeCN per silver mole introduced at approximately 70% of the precipitation and 0.003 mg $K_2IrCl_6$ per Ag mole introduced at approximately 65%. The emulsion was optimally chemically and spectrally sensitized by adding the antifoggant HB3, NaSCN, $9.9\times10^{-4}$ mole/mole Ag of the green sensitizing dye GSD-1, $2.5\times10^{-4}$ mole/mole Ag of the green sensitizing dye GSD-2, $Na_3Au(S_2O_3)_2.2H_2O$, $Na_2S_2O_3.5H_2O$ and a benzothiazolium finish modifier. The emulsion was then subjected to a heat cycle to 60° C. The antifoggant-stabilizer, tetraazaindene, at a concentration of $2.9\times10^{-3}$ mole/mole silver, was added to the emulsion melt after the chemical sensitization procedure.

Emulsion E-4

An AgBrI tabular silver halide emulsion (Emulsion E-4) was prepared containing 3% total iodide distributed such that the central portion of the emulsion grains contained no iodide and the perimeter area contained substantially higher iodide as described by Chang et. al., U.S. Pat. No. 5,314,793. The emulsion grains had an average thickness of 0.11 $\mu$m and average circular diameter of 0.5 $\mu$m. The emulsion was precipitated and doped in a manner similar to Emulsion E-3 described above. The emulsion was optimally chemically and spectrally sensitized by adding NaSCN, $7.4\times10^{-4}$ mole/mole Ag of the green sensitizing dye GSD-1, $1.8\times10^{-4}$ mole/mole Ag of the green sensitizing dye GSD-2, $Na_3Au(S_2O_3)_2.2H_2O$, $Na_2S_2O_3.5H_2O$ and a benzothiazolium finish modifier. The emulsion was then subjected to a heat cycle to 60° C. The antifoggant-stabilizer, tetraazaindene, at a concentration of $5.8\times10^{-3}$ mole/mole silver, was added to the emulsion melt after the chemical sensitization procedure.

Emulsion E-5

A cubic AgBrI emulsion (Emulsion E-6) was prepared containing 3.5 percent total iodide distributed evenly throughout the emulsion grains. The cubic emulsion grains have an average equivalent spherical diameter of 0.28 microns. The emulsion was precipitated under double jet conditions at 40 degrees C. in standard gelatin using a straight-chain thioether ripener for size control. The only dopant, 0.315 mg of $K_2IrCl_6$ per silver mole, was added during a hold after a one minute nucleation. After ultrafiltration, the emulsion was optimally spectrally and chemically sensitized using 0.72 mmoles of GSD-1 and 0.18 mmoles of GSD-2, standard sources for sulfur and gold and a benzothiazolium finish modifier. The emulsion was subjected to a heat cycle at 65 degrees C. The antifoggant stabilizer, tetraazaindene, at a concentration of 10 mmoles per mole of silver, was added to the emulsion melt after the chemical sensitization process.

ML Sample B 1:

The multilayer film structure utilized for this example is shown below, with structures of components provided at the end of the example section. Component laydowns are in grams per meter squared unless otherwise stated, emulsion sizes are reported in Diameter x Thickness in microns. 1,1'-(methylene bis(sulfonyl))bis-ethene hardener was used at 1.6% of total gelatin weight. Antifoggants (including 4-hydroxy-6-methyl-1,3,3a,7-tetraazaindene), surfactants, coating aids, coupler solvents, emulsion addenda, sequesterants, lubricants, matte and tinting dyes were added to the appropriate layers as is common in the art. Layers are numbered beginning with the layer furthest from the support. Layer 6 was the experimental layer with variations of emulsion E-2 containing the FED compound FED-15 coated in the layer. When the FED compound was present in the layer, the antifoggant HB3 at 4 g/mole Ag was also added to the layer. When the reductone compound R-2 was added to a ML sample, it was combined with the coupler dispersion components of layer 4, which were mixed with the emulsion components of layer 4 just prior to coating Layer 1 (Protective Overcoat Layer): gelatin at 0.89.

Layer 2 (UV Filter Layer): silver bromide Lippman emulsion at 0.215, UV-1 at 0.097, UV-2 at 0.107, ADD-08 at 0.0012, and gelatin at 0.699.

Layer 3 (Fast Yellow Layer): a blend of two blue sensitized (with a mixture of BSD-1 and BSD-2) tabular silver iodobromide emulsions: (i) 2.7×0.13 $\mu$m, 4.1 mole % iodide at 0.312, (ii) 1.3×0.14 $\mu$m, 4.1 mole % iodide at 0.312. Yellow dye-forming coupler YC-1 at 0.258, IR-1 at 0.129, bleach accelerator releasing coupler B-1 at 0.005 and gelatin at 0.915.

Layer 4 (Slow Yellow Layer): a blend of three blue sensitized (all with a mixture of BSD-1 and BSD-2) tabular silver iodobromide emulsions: (i) 1.3×0.14 $\mu$m, 4.1 mole % iodide at 0.323, (ii) 0.8×0.14 $\mu$m, 1.5 mole % iodide at 0.355, and (iii) 0.5×0.08 $\mu$m, 1.5 mole % iodide at 0.182. Yellow dye-forming couplers YC-1 at 0.699 and YC-2 at 0.430, IR-1 at 0.161, IR-2 at 0.022, bleach accelerator releasing coupler B-1 at 0.005, and gelatin at 2.23.

Layer 5 (Yellow filter layer): YFD-1 at 0.102, OxDS-1 at 0.075, A-1 at 0.043, and gelatin at 0.538.

Layer 6 (Fast Magenta Layer): Emulsion E-2 at 0.775, magenta dye-forming coupler MC-1 at 0.102, masking coupler MM-1 at 0.032, IR-3 at 0.036, IR-4 at 0.003 and gelatin at 0.936.

Layer 7 (Mid Magenta Layer): a blend of two green sensitized (with a mixture of GSD-1 and GSD-2) silver iodobromide tabular emulsions: (i) 0.8×0.12 μm, 4.5 mole % iodide at 0.071 and (ii) 0.6×0.11 μm, 4.5 mole % iodide at 0.151. Magenta dye-forming coupler MC-1 at 0.247, masking coupler MM-1 at 0.118, IR-3 at 0.027, IR-5 at 0.024, and gelatin at 1.45.

Layer 8 (Slow magenta layer): a blend of three green sensitized silver iodobromide emulsions: (i) E-3 at 0.172, (ii) E-4 at 0.29, and (iii) E-5 at 0.29. Magenta dye-forming coupler MC-1 at 0.430, masking coupler MM-1 at 0.108, IR-5 at 0.031 and gelatin at 1.52.

Layer 9 (Interlayer): OxDS-1 at 0.081 and gelatin at 0.538.

Layer 10 (Fast Cyan layer): a red-sensitized sensitized (with a mixture of RSD-1, RSD-2 and RSD-3) tabular silver iodobromide emulsion (1.4×0.13 μm, 3.7 mole % iodide) at 0.860, cyan dye-forming couplers CC-1 at 0.136, CC-2 at 0.027, CC-3 at 0.007, IR-6 at 0.043, IR-7 at 0.059, masking coupler CM-1 at 0.038, and gelatin at 1.62.

Layer 11 (Mid Cyan Layer): a blend of two red-sensitized (both with a mixture of RSD-1, RSD-2, and RSD-3) silver iodobromide tabular emulsions: (i) 1.2×0.11 μm, 4.1 mole % iodide) at 0.344 and (ii) 1.0×0.11 μm, 4.1 mole % iodide at 0.430. Cyan dye-forming coupler CC-1 at 0.269, IR-2 at 0.038, masking coupler CM-1 at 0.016, and gelatin at 1.13.

Layer 12 (Slow cyan layer): a blend of two red sensitized (both with a mixture of RSD-1, RSD-2, and RSD-3) tabular silver iodobromide emulsions: (i) 0.7×0.12 μm, 4.1 mole % iodide at 0.484 and (ii) 0.5×0.08 μm, 1.5 mole % iodide at 0.646. Cyan dye-forming coupler CC-1 at 0.583, IR-7 at 0.034, bleach accelerator releasing coupler B-1 at 0.086 and gelatin at 1.92.

Layer 13 (Interlayer): OxDS-1 at 0.075 and gelatin at 0.538.

Layer 14 (Antihalation layer): Black Colloidal Silver at 0.151, OxDS-1 at 0.081, HB3 at 0.270, ADD-1 at 0.001; ADD-3 at 0.007, and gelatin at 1.61.

Support: annealed poly(ethylene naphthalate) with an applied magnetic layer on the backside as described in *Research Disclosure*, November 1992, Item 34390 published by Kenneth Mason Publications, Ltd., Dudley Annex, 12a North Street, Emsworth, Hampshire P010 7DQ, ENGLAND, and as described in Hatsumei Kyoukai Koukai Gihou No. 94-6023, published Mar. 15, 1994, available from the Japanese Patent Office.

ML-B2 through B6 are like ML-B1 except that the FED compound FED-15 was added to layer 6 prior to coating as described in Table III.

Samples of each element were exposed and processed as described for Example 1 except that the exposure time used was 0.01 sec. Green speed was measured in relative log units as (1-logH) where H is the exposure in lux-sec necessary to produce a magenta density 0.15 above Dmin. Relative speed was set equal to 1.00 for the multilayer element containing no FED compound.

Latent image keeping was measured by aging samples of each element for 10 weeks at 78° F. and 50% RH, then exposing the samples as described above, and then aging the samples for a further 2 weeks at 78° F. and 50% RH before processing the samples as described above. Latent image keeping density changes for the fast magenta (FM) layer were determined by comparing the magenta density obtained at Step 7 (approximately 0.4 density units above Dmin) for these samples to the magenta density obtained at Step 7 for samples that were aged for 12 weeks at 78° F. and 50% RH before exposing and processing. Latent image keeping density changes for the slow magenta (SM) layer were determined in the same manner except that the magenta density was measured at step 15 (approximately 1.4 density units above Dmin). Changes in Dmin with keeping were obtained by comparing the magenta Dmin obtained for samples that were aged for 4 weeks at 100° F. and 50% RH before exposing and processing to the Dmin obtained for samples that were held for 4 weeks at 0° F. and 50% RH before exposing and processing.

TABLE II

Fresh speed and keeping behavior for magenta record of multilayers with FED-15 and R-2 added

| ML | Amount of FED (mg/mole Ag) in FM | Amount of R-2 (mg/ft2) | Fresh speed | Fresh Dmin | Δ density with LIK in FM | Δ density with LIK in SM | Δ Dmin with keeping |
|---|---|---|---|---|---|---|---|
| B1 | None | None | 1.00 | 0.66 | −0.07 | −0.11 | 0.01 |
| B2 | 0.3 | None | 1.01 | 0.67 | −0.04 | −0.12 | 0.03 |
| B3 | 0.6 | None | 1.02 | 0.67 | −0.02 | −0.10 | 0.05 |
| B4 | None | 0.7 | 1.01 | 0.67 | −0.05 | −0.02 | 0.02 |
| B5 | 0.3 | 0.7 | 1.01 | 0.67 | −0.05 | −0.02 | 0.01 |
| B6 | 0.6 | 0.7 | 1.00 | 0.67 | −0.03 | −0.02 | 0.02 |

The data in Table II show that without the FED compound or the reductone in the multilayer coating, there was significant loss of density with latent image keeping for densities corresponding to both the fast magenta layer and the slow magenta layer. When FED-15 was added to the fast magenta layer, the density loss related to this layer was reduced in proportion to the amount of FED-15 used but the Dmin gain with high temperature keeping was increased. (ML's B2 and B3 vs. ML B1) Addition of the reductone R-2 to the coating significantly improved the latent image keeping density loss related to the slow magenta layer but only slightly improved the latent image keeping density loss from the fast magenta. (ML B4 vs. ML B1). Combination of R-2 with FED-15 at the 0.6 mg/mole Ag level (ML B6) provided a significantly improved latent image keeping position in both the fast and slow magenta layers with minimized high temperature keeping fog growth.

Chemical Structures for Examples

UV-1

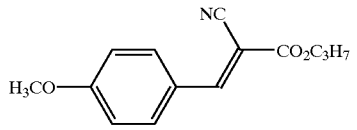

UV-2

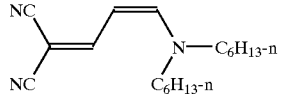

-continued
YC-1
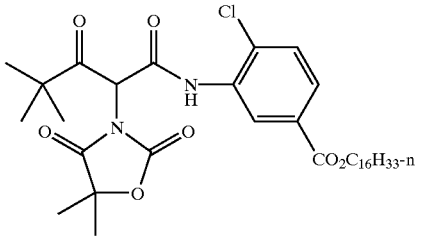
YC-2
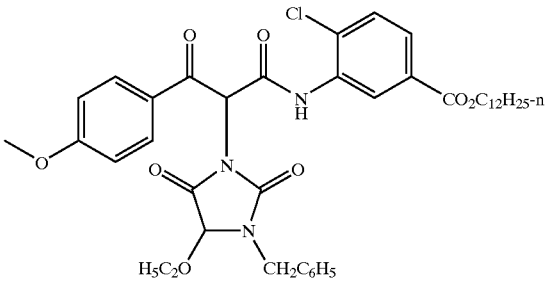
MC-1
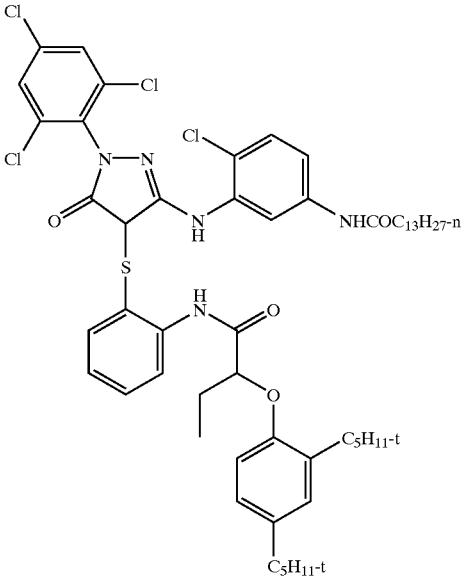
CC-1
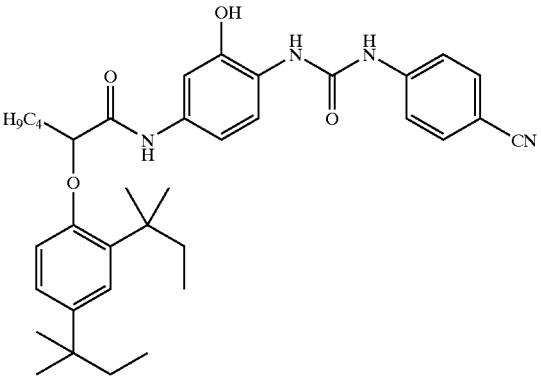
-continued
MM-1
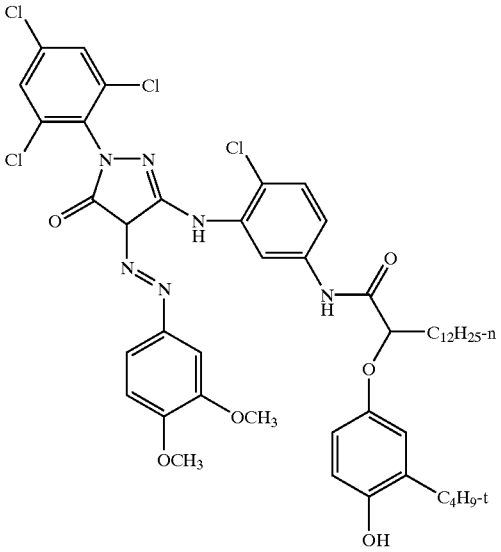
CM-1
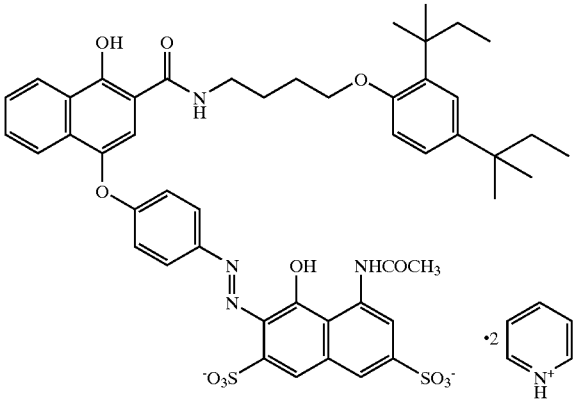
IR-1
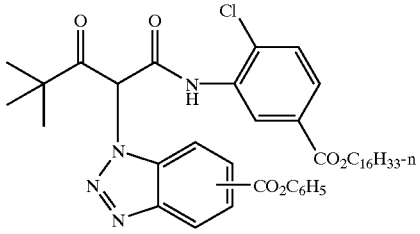
IR-2
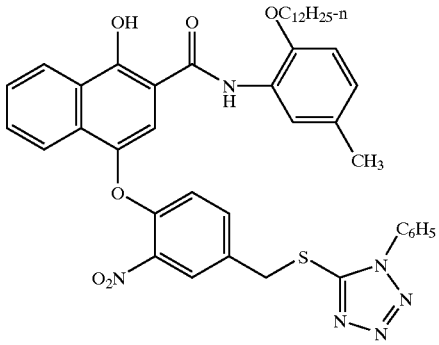

-continued
IR-3
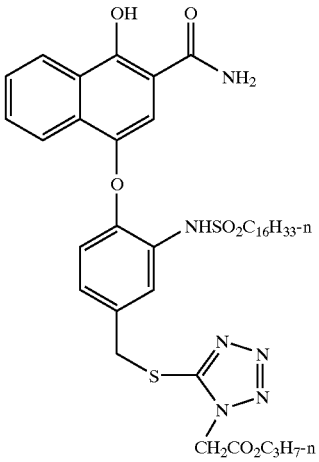
IR-4
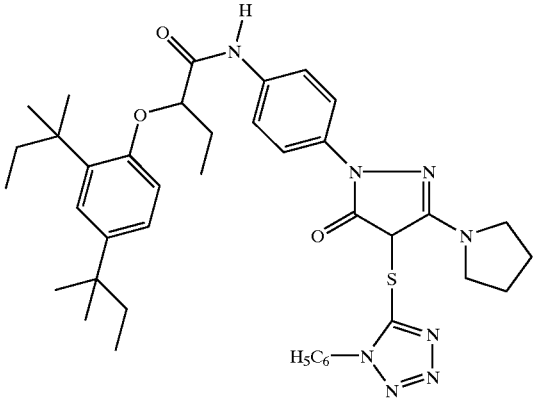
IR-5
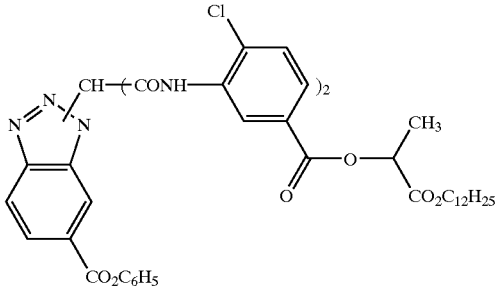
IR-6
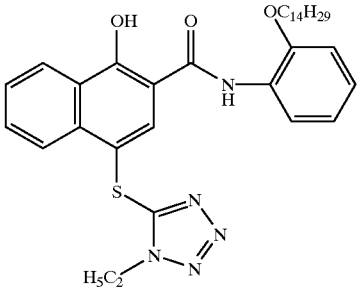
-continued
IR-7
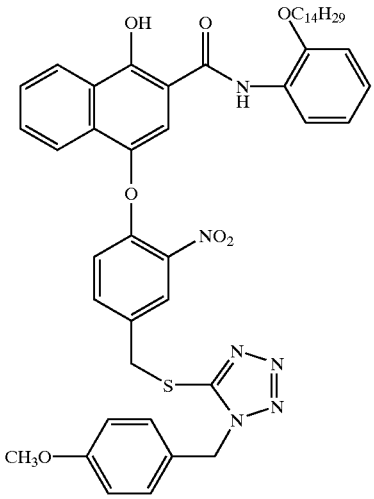
IR-8
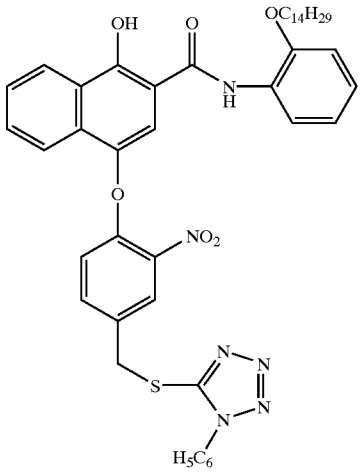
B-1
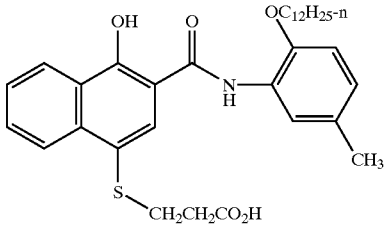
A-1
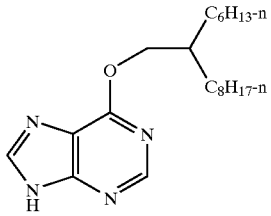

-continued
BSD-1
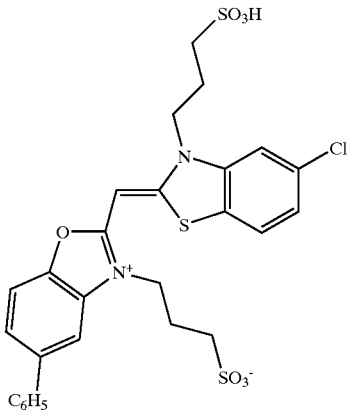
BSD-2
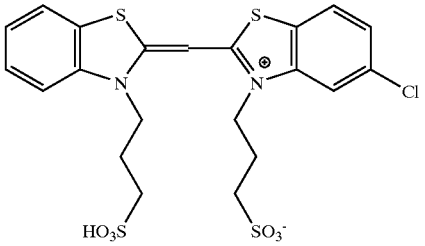
BSD-3
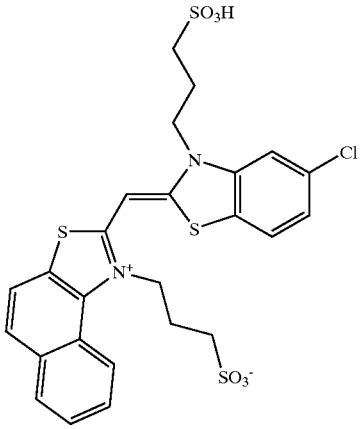
GSD-1
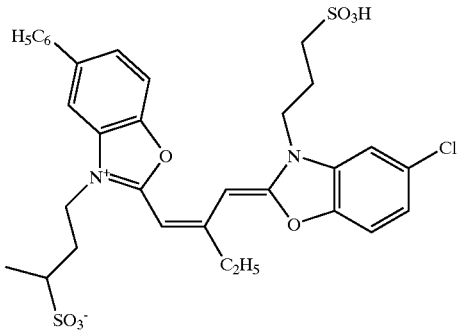
-continued
GSD-2
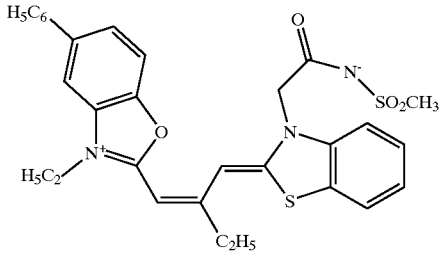
GSD-3
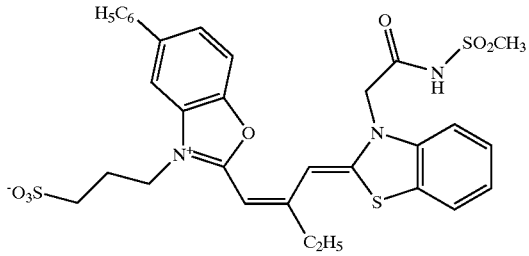
RSD-1
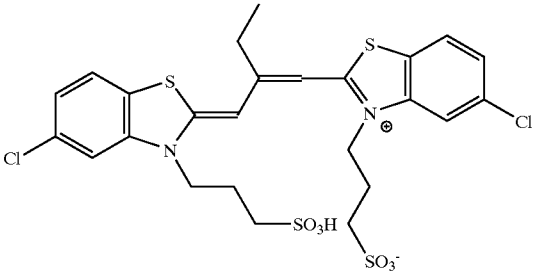
RSD-2
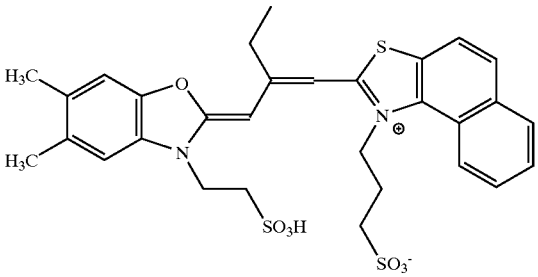
RSD-3
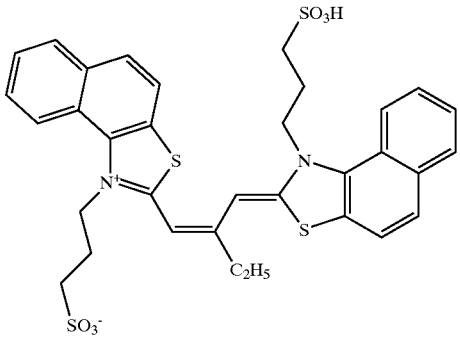

-continued

RSD-4

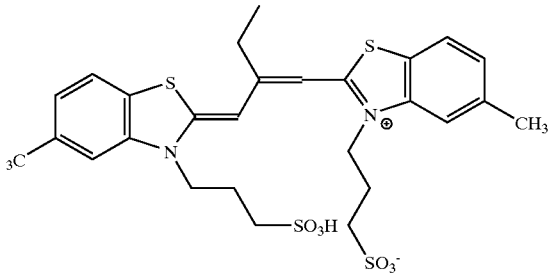

OxDS-1

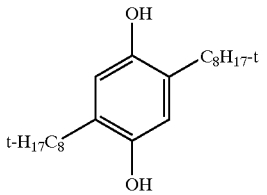

OxDS-2

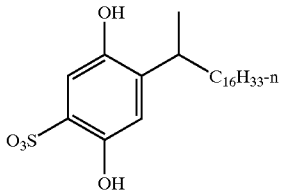

YFD-1

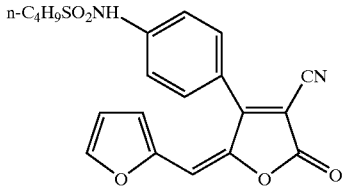

ADD-1

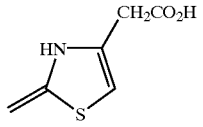

ADD-2

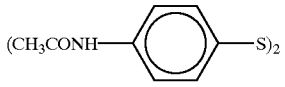

ADD-3 Sodiium Hexametaphosphate

ADD-6 4-Hydroxy-6-methyl-1,3,3A,7-tetraindene

ADD-7 $Au_2S$

ADD-8 $MnSO_4$

ADD-9 $PdCl_4^{2-}\cdot(NH_4^+)_2$

The invention has been described in detail with particular reference to certain preferred embodiments thereof, but it will be understood that variations and modifications can be effected within the spirit and scope of the invention.

What is claimed is:

1. A photographic element comprising at least one light-sensitive silver halide emulsion layer containing a fragmentable electron donating compound of the formula: X—Y' or a compound which contains a moiety of the formula —X—Y';

wherein

X is an electron donor moiety, Y' is a leaving proton H or a leaving group Y, with the proviso that if Y' is a proton, a base, $\beta^-$, is present in the emulsion layer, and wherein:

1) X—Y' has an oxidation potential between 0 and about 1.4 V; and 2) the oxidized form of X—Y' undergoes a bond cleavage reaction to give the radical $X^{\bullet}$ and the leaving fragment Y'; and 3) the radical $X^{\bullet}$ has an oxidation potential $\leqq -0.7V$;

said photographic element further comprising a reductone of the Formula 2:

2

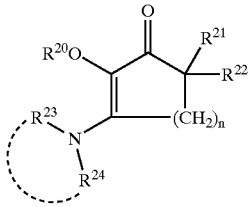

wherein $R^{23}$ and $R^{24}$ are the same or different, and may represent H, alkyl, cycloalkyl, aryl, or an alkyl group with a solubilizing group, or $R^{23}$ and $R^{24}$ may be joined to complete a heterocyclic ring, $R^{21}$ and $R^{22}$ are H, OH, alkyl, aryl, cycloalkyl, or may together represent an alkylidene group, n is 1 or 2 and $R^{20}$ is H, alkyl, aryl, or $CO_2R^{25}$ where $R^{25}$ is alkyl.

2. A photographic element according to claim 1, which is a multicolor photographic element comprising a support bearing a cyan dye image-forming unit comprising at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler.

3. A photographic element according to claim 1 or claim 2, wherein the reductone has a logarithm of the partition coefficient for the reductone when equilibrated as a solute between n-octanol and water (logP) of less than 0.293.

4. A photographic element according to claim 1 or claim 2, wherein wherein $R^{23}$ and $R^{24}$ complete a morpholino ring.

5. A photographic element according to claim 1 or claim 2, wherein $R^{20}$ is hydrogen, $R^{21}$ is —OH, $R^{22}$ is methyl and n is 1.

6. A photographic element according to claim 1 or claim 2, wherein each of $R^{23}$ and $R^{24}$ is a methyl group, $R^{20}$ is hydrogen, $R^{21}$ is —OH, $R^{22}$ is methyl and n is 1.

7. A photographic element according to claim 1 or claim 2, wherein the reductone is of the formula:

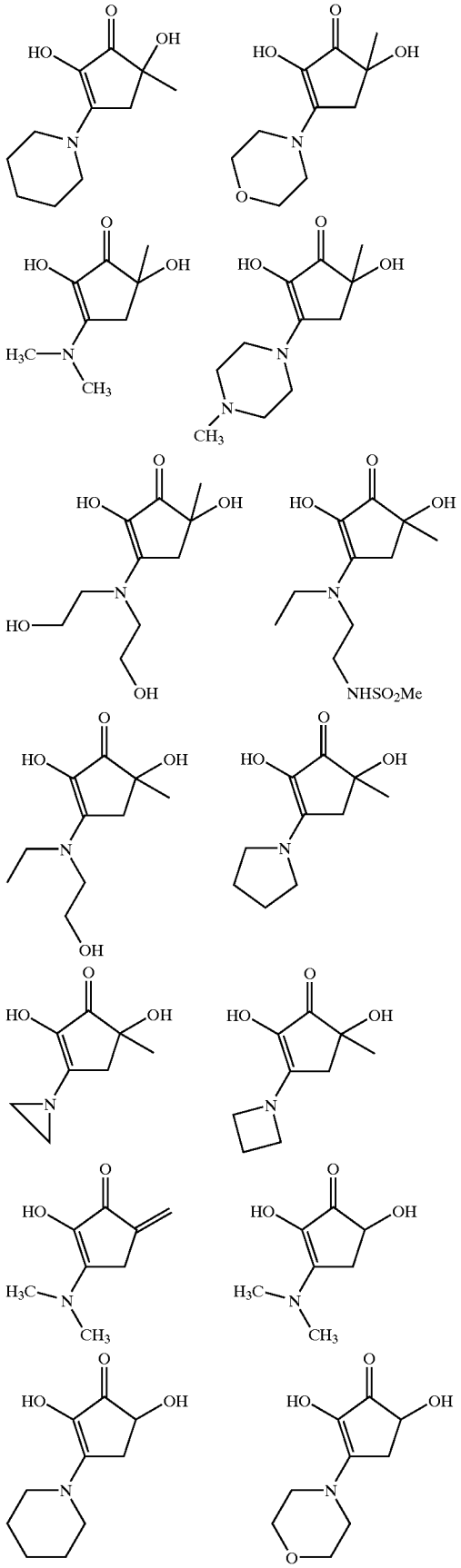
-continued
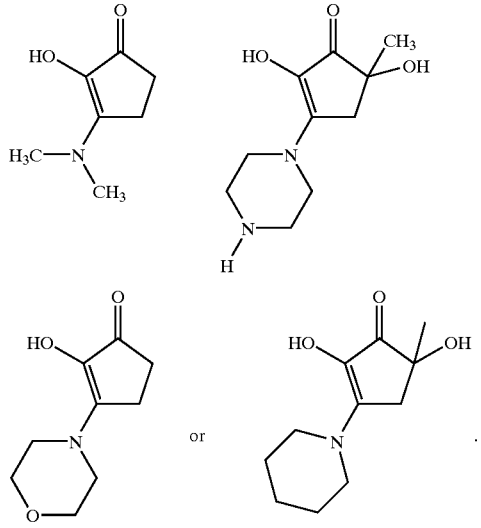
8. A photographic element according to claim 1 or claim 2, wherein the reductone is present in an amount of about 0.002 to about 200 micromoles/$m^2$.
9. A photographic element according to claim 8, wherein X is selected from:
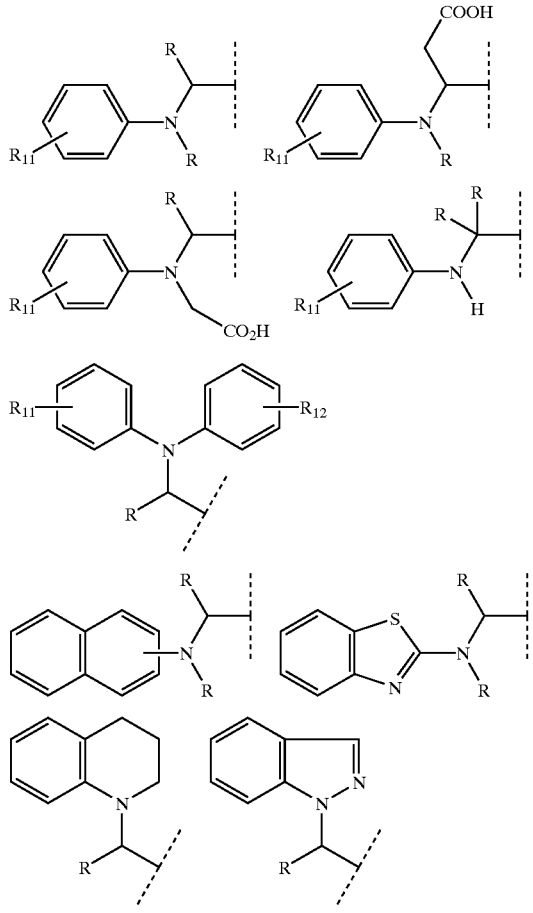

-continued

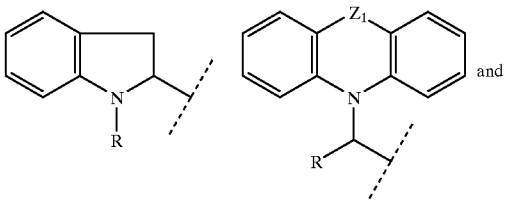

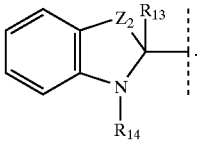

R11 and R12 = { H, alkyl, alkoxy, alkylthio, halo, carbamoyl or carboxyl, amido, formyl, sulfonyl, sulfonamido, nitrile }

$Z_1$=a covalent bond, S, O, Se, NR, $CR_2$, CR═CR, or $CH_2CH_2$;

$Z_2$=S, O, Se, NR, $CR_2$, or CR═CR;

R13,=alkyl, substituted alkyl or aryl; and

R14=H, alkyl substituted alkyl or aryl.

10. A photographic element according to claim 1 or claim 2, wherein the reductone is present in an amount of about 10 to about 100 micromoles/$m^2$.

11. A photographic element according to claim 1 or claim 2, wherein the emulsion layer containing the fragmentable electron donating compound comprises silver bromoiodide grains.

12. A photographic element according to claim 11, wherein the grains are tabular grains.

13. A photographic element according to claim 1 or claim 2, wherein the amount of fragmentable electron donating compound is about $1\times10^{-9}$ mole per mole silver in the emulsion to about 0.1 mole per mole of silver.

14. A photographic element according to claim 1 or claim 2, wherein the amount of fragmentable electron donating compound is about $5\times10^{-9}$ mole per mole silver in the emulsion to about 0.05 mole per mole of silver.

15. A photographic element according to claim 1, wherein X is of structure (I):

(I)

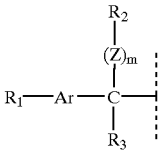

$R_1$=R, carboxyl, amide, sulfonamide, halogen, $NR_2$, $(OH)_n$, $(OR')_n$, or $(SR)_n$;

R'=alkyl or substituted alkyl group;

n=1–3;

$R_2$=R, or Ar';

$R_3$=R, or Ar';

$R_2$ and $R_3$ together can form a 5- to 8-membered ring wherein:

m=0, or 1;

Z=O, S, Se, or Te;

$R_2$ and Ar can be linked to form a 5- to 8-membered ring;

$R_3$ and Ar can be linked to form a 5- to 8-membered ring;

Ar'=aryl group or heterocyclic group; and

R=a hydrogen atom or an unsubstituted or substituted alkyl group.

16. A photographic element according to claim 15, wherein the compound of Structure (I) is selected from:

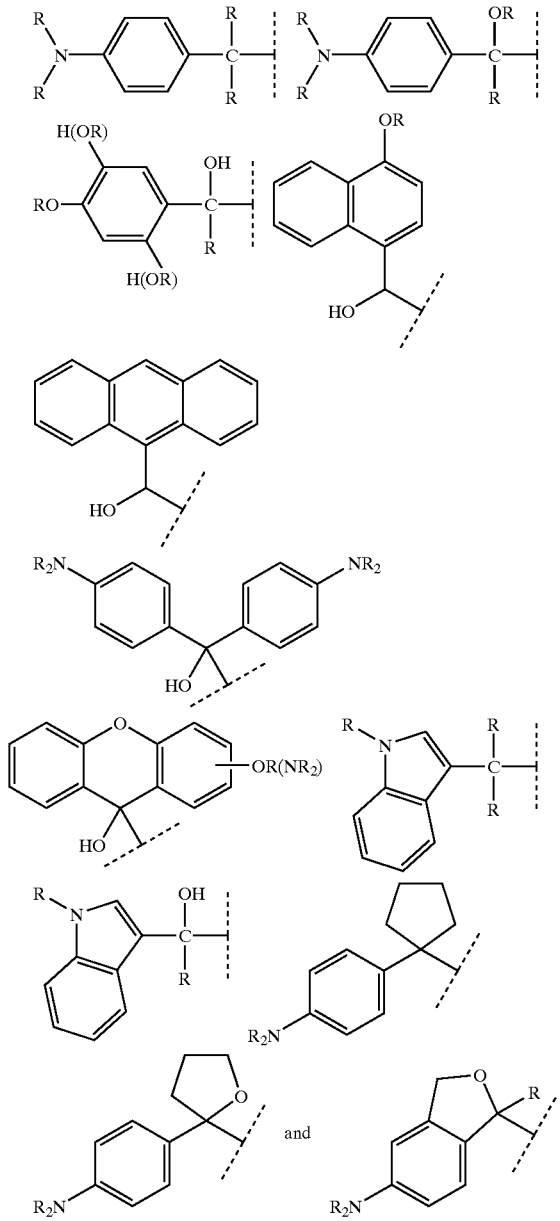

wherein each R is independently a hydrogen atom or a substituted or unsubstituted alkyl group.

17. A photographic element according to claim 1, wherein X is a compound of structure (II):

(II)

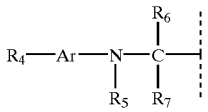

wherein:

Ar=aryl group or heterocyclic group $R_4$=a substituent having a Hammett sigma value of −1 to +1, $R_5$=R or Ar'

$R_6$ and $R_7$=R or Ar'

$R_5$ and Ar=can be linked to form a 5- to 8-membered ring;

$R_6$ and Ar=can be linked to form a 5- to 8-membered ring (in which case, $R_6$ can be a hetero atom);

$R_5$ and $R_6$ can be linked to form a 5- to 8-membered ring;

$R_6$ and $R_7$ can be linked to form a 5- to 8-membered ring;

Ar'=aryl group or heterocyclic group; and

R=hydrogen atom or an unsubstituted or substituted alkyl group.

18. A photographic element according to claim 1, wherein X is a compound of structure (III):

(III)

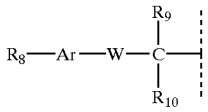

wherein:

W=O, S, or Se;

Ar=aryl group or heterocyclic group;

$R_8$=R, carboxyl, $NR_2$, $(OR)_n$, or $(SR)_n$ (n=1–3);

$R_9$ and $R_{10}$=R, or Ar';

$R_9$ and Ar=can be linked to form a 5- to 8-membered ring;

Ar'=aryl group or heterocyclic group; and

R=a hydrogen atom or an unsubstituted or substituted alkyl group.

19. A photographic element according to claim 18, wherein X is selected from:

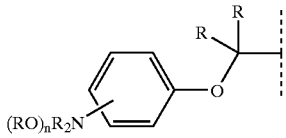

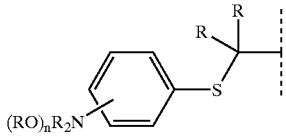

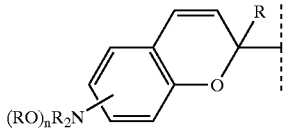

and

-continued

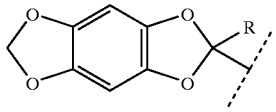

n = 1–3.

20. A photographic element according to claim 1, wherein X is of structure (IV):

(IV)

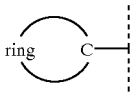

wherein:

"ring" represents a substituted or unsubstituted 5-, 6- or 7-membered unsaturated ring.

21. A photographic element according to claim 20, wherein X is selected from:

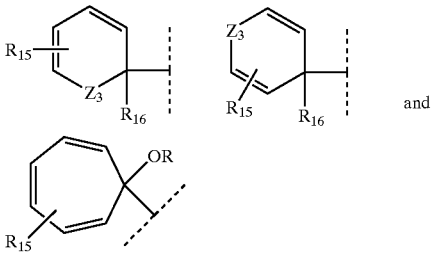

and $Z_3$=O, S, Se or NR $R_{15}$=R, OR or $NR_2$ $R_{16}$=alkyl or substituted alkyl.

22. A photographic element according to claim 1, wherein Y' is:

(1) X', where X' is an X group as defined in structures I–IV and may be the same as or different from the X group to which it is attached (2)

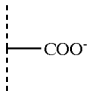

(3)

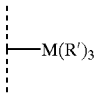

where M=Si, Sn or Ge; and R'=alkyl or substituted alkyl (4)

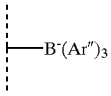

where Ar"=aryl or substituted aryl (5)

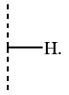

23. A photographic element according to claim 1, wherein the fragmentable electron donor compound is selected from compounds of the formulae:

$Z—(L—X—Y')_k$ $A—(L—X—Y')_k$ $(A—L)_k—X—Y'$ $Q—X—Y'$ $A—(X—Y')_k$ $(A)_k—X—Y'$ $Z—(X—Y')_k$ or $(Z)_k—X—Y'$ wherein:

Z is a light absorbing group;

k is 1 or 2;

A is a silver halide adsorptive group;

L represents a linking group containing at least one C, N, S, P or O atom; and

Q represents the atoms necessary to form a chromophore comprising an amidinium-ion, a carboxyl-ion or dipolar-amidic chromophoric system when conjugated with X—Y'.

24. A photographic element according to claim 23, wherein the fragmentable electron donor compound is of the formula:

$Z—(L—X—Y')_k$ $Z—(X—Y')_k$ or $(Z)_k—X—Y'$ wherein Z is derived from a cyanine dye, complex cyanine dye, merocyanine dye, complex merocyanine dye, homopolar cyanine dye, styryl dye, oxonol dye, hemioxonol dye, or hemicyanine dye.

25. A photographic element according to claim 23, wherein the fragmentable electron donor compound is of the formula:

$A—(L—X—Y')_k$ $(A—L)_k—X—Y'$ $A—(X—Y')_k$ or $(A)_k—X—Y'$ wherein: A is a silver-ion ligand moiety or a cationic surfactant moiety.

26. A photographic element according to claim 25, wherein A is selected from the group consisting of: i) sulfur acids and their Se and Te analogs, ii) nitrogen acids, iii) thioethers and their Se and Te analogs, iv) phosphines, v) thionamides, selenamides, and telluramides, and vi) carbon acids.

27. A photographic element according to claim 23, wherein the fragmentable electron donor compound is of the formula:

$Q—X—Y'$ wherein Q represents a chromophoric system comprising a cyanine, complex cyanine, hemicyanine, merocyanine, or complex merocyanine dye.

28. A photographic element according to claim 1, wherein the fragmentable electron donor compound is selected from the group consisting of:

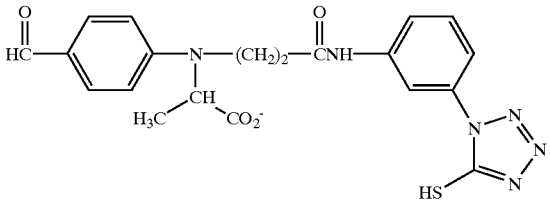

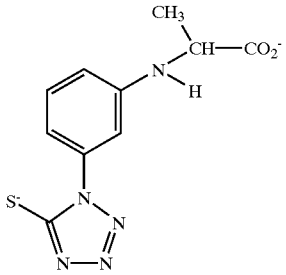

-continued
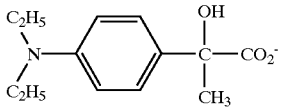
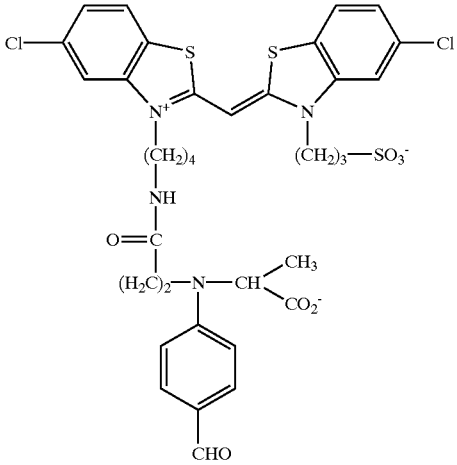
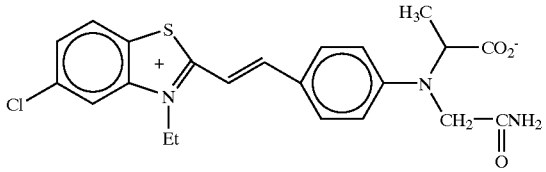
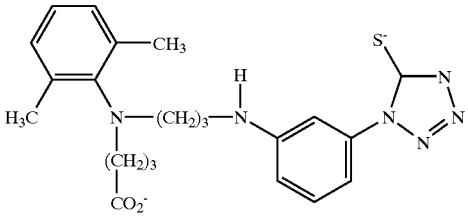
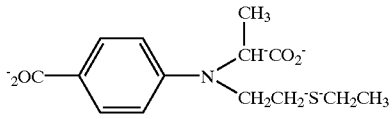
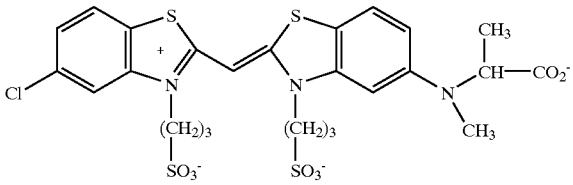
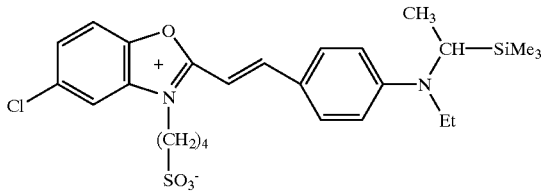
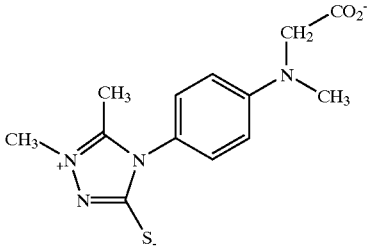
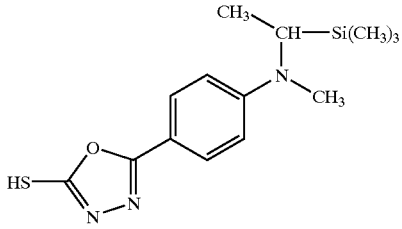
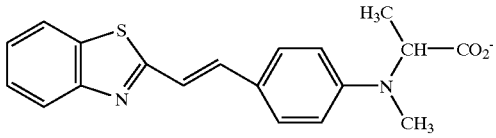
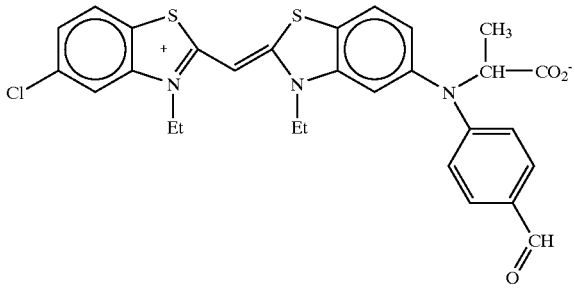

-continued
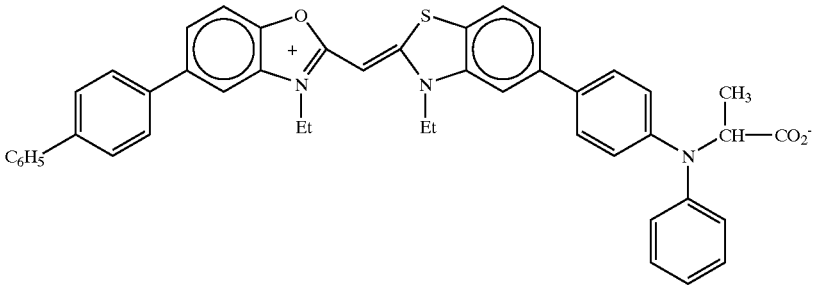
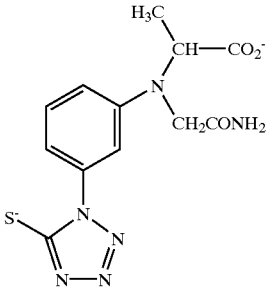
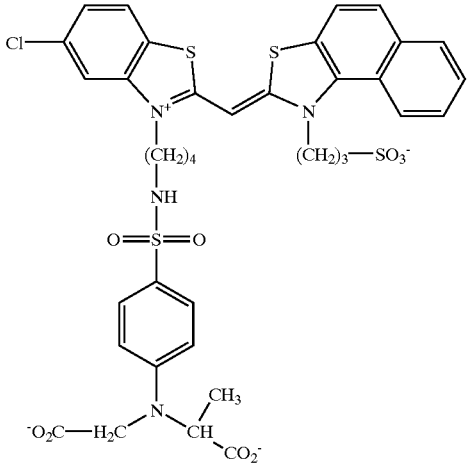
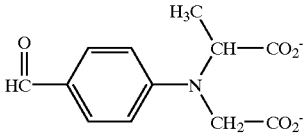
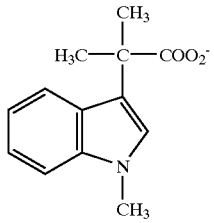
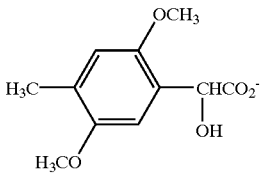
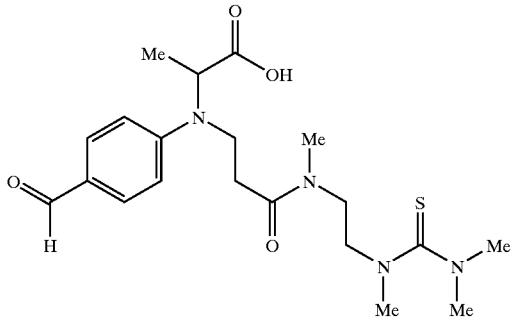
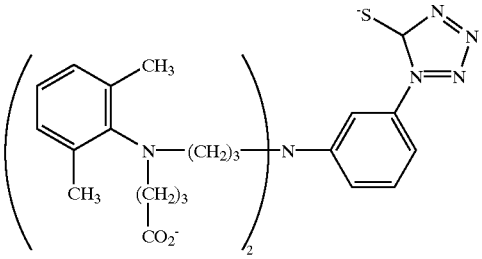
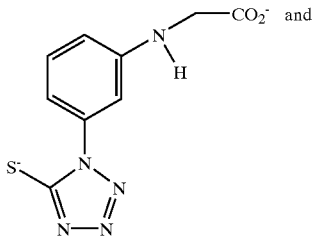
and -continued
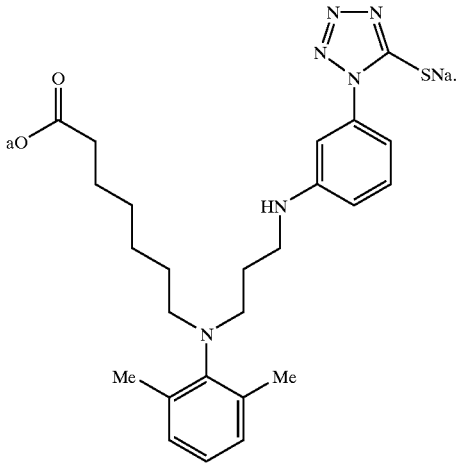
* * * * *